US008257057B2

(12) United States Patent
Yamamuro et al.

(10) Patent No.: US 8,257,057 B2
(45) Date of Patent: Sep. 4, 2012

(54) VARIABLE DISPLACEMENT VANE PUMP

(75) Inventors: Shigeaki Yamamuro, Zushi (JP); Hideo Konishi, Kanagawa (JP); Fusao Semba, Saitama (JP)

(73) Assignee: Hitachi, Ltd., Tokyo (JP)

( * ) Notice: Subject to any disclaimer, the term of this patent is extended or adjusted under 35 U.S.C. 154(b) by 986 days.

(21) Appl. No.: 12/188,945

(22) Filed: Aug. 8, 2008

(65) Prior Publication Data

US 2009/0047141 A1 Feb. 19, 2009

(30) Foreign Application Priority Data

Aug. 17, 2007 (JP) ..... 2007-212857

(51) Int. Cl.

| | |
|---|---|
| ***F04B 49/00*** | (2006.01) |
| ***F01C 20/18*** | (2006.01) |
| ***F03C 4/00*** | (2006.01) |
| ***F04C 2/00*** | (2006.01) |
| ***F04C 14/18*** | (2006.01) |
| ***F04C 28/22*** | (2006.01) |
| ***F04C 27/00*** | (2006.01) |
| ***F01C 19/08*** | (2006.01) |
| ***F01C 19/10*** | (2006.01) |

(52) U.S. Cl. ..... 417/220; 417/410.3; 418/26; 418/27; 418/30; 418/133

(58) Field of Classification Search ..... 417/220, 417/410.3; 418/133, 26–30, 131, 134
See application file for complete search history.

(56) References Cited

U.S. PATENT DOCUMENTS

| | | | | |
|---|---|---|---|---|
| 6,042,343 | A * | 3/2000 | Semba et al. | 417/220 |
| 6,120,270 | A * | 9/2000 | Parsch | 418/133 |
| 6,280,150 | B1 | 8/2001 | Miyazawa | |
| 2006/0034721 | A1* | 2/2006 | Uchino | 418/29 |

FOREIGN PATENT DOCUMENTS

JP 11-093856 A 4/1999

* cited by examiner

*Primary Examiner* — Devon C Kramer
*Assistant Examiner* — Bryan Lettman
(74) *Attorney, Agent, or Firm* — Foley & Lardner LLP

(57) ABSTRACT

A variable displacement vane pump includes a rotor, a swingable annular cam ring receiving therein the rotor, a pump body encasing the cam ring and rotor, and a pressure plate which is disposed between an end wall of the pump body and the rotor and which includes a backup surface and a sliding surface formed with an inlet port, an outlet port and a backpressure groove. The vane pump further includes a seal member which is provided between the backup surface of the pressure plate and the end wall of the pump body, and which includes an inlet-side segment extending on the radial inner side of the inlet port and the radial outer side of the backpressure groove, and an outlet-side segment extending on the radial outer side of the outlet port.

29 Claims, 12 Drawing Sheets

VARIABLE DISPLACEMENT VANE PUMP

BACKGROUND OF THE INVENTION

The present invention relates to variable displacement vane pumps.

A Japanese patent document JP H11-93856A (≈U.S. Pat. No. 6,280,150B1) shows a variable displacement vane pump provided with a pressure plate including a sliding surface contacting with a rotor and an opposite surface receiving a high pressure to press the pressure plate onto the rotor to reduce leakage in the sliding surface.

SUMMARY OF THE INVENTION

However, in the above-mentioned vane pump, the pressure plate tends to be deformed by receiving axial forces in an unbalanced state, or receiving an excessive pressure pressing the pressure plate to the rotor. To increase the axial thickness of the pressure plate to prevent undesired deformation would increase the size and weight of the vane pump.

It is therefore an object of the present invention to provide a variable displacement vane pump adapted to improve pressure balance in a pressure plate to prevent deformation.

According to one aspect of the present invention, a variable displacement vane pump comprises: a pump body; a drive shaft supported by the pump body; a rotor which is provided in the pump body, which is connected with the drive shaft to be driven by the drive shaft, and which is formed with a plurality of slots; a plurality of vanes each slidably received in one of the slots; a plurality of back pressure chambers each provided on a radial inner side of one of the slots; an annular cam ring which surrounds the rotor, which is arranged to swing about a swing support point in the pump body, and to define a plurality of pumping chambers with the vanes between the rotor and the cam ring; first and second plate members provided on both sides of the cam ring in an axial direction, the second plate member including a sliding surface to contact with the rotor and a backup surface facing away from the rotor; an inlet port formed in the sliding surface of the second plate member in a volume increasing region in which volumes of the pumping chambers are increased, and an outlet port formed in the sliding surface of the second plate member in a volume decreasing region in which the volumes of the pumping chambers are decreased; an interspace surrounding the cam ring, and including a first pressure chamber on a side on which a discharge quantity increases and a second pressure chamber on a side on which the discharge quantity decreases; a pressure control device to control a fluid pressure to be introduced to the first or second pressure chamber; an inlet-side back pressure groove formed in the sliding surface on the radial inner side of the inlet port and arranged to lead to the back pressure chambers, and an outlet-side back pressure groove formed in the sliding surface on the radial inner side of the outlet port and arranged to lead to the back pressure chambers; a rotor-side suction region defined in the sliding surface of the second plate member, the rotor-side suction region being a region bounding a suction pump chamber which is one of the pumping chambers in fluid communication with the inlet port; a rotor-side discharge region defined in the sliding surface of the second plate member, the rotor-side discharge region being a region bounding a discharge pump chamber which is one of the pumping chambers in fluid communication with the outlet port; a backup-side lower pressure region formed in the backup surface of the second plate member at a position opposing the rotor-side suction region and arranged to receive an intake pressure; a backup-side higher pressure region formed in the backup surface of the second plate member at a position opposing the rotor-side discharge region and arranged to receive a discharge pressure; a seal member provided on the backup surface and arranged to separate the backup side higher pressure region and the backup side lower pressure region from each other; a first closing region defined in the sliding surface and bounded between a leading end of the outlet port and a trailing end of the inlet port; a second closing region defined in the sliding surface and bounded between a leading end of the inlet port and a trailing end of the outlet port; a first projected higher pressure region which is provided in a first projection region formed by projection of the first closing region on the backup surface and which is arranged to receive a higher pressure; and a second projected higher pressure region which is provided in a second projection region formed by projection of the second closing region on the backup surface and which is arranged to receive the higher pressure.

DETAILED DESCRIPTION OF THE INVENTION

First Embodiment

FIGS. 1~12 are views for showing a variable displacement vane pump according to a first embodiment of the present invention.

[Outline of Variable Displacement Vane Pump]

Figure 1:
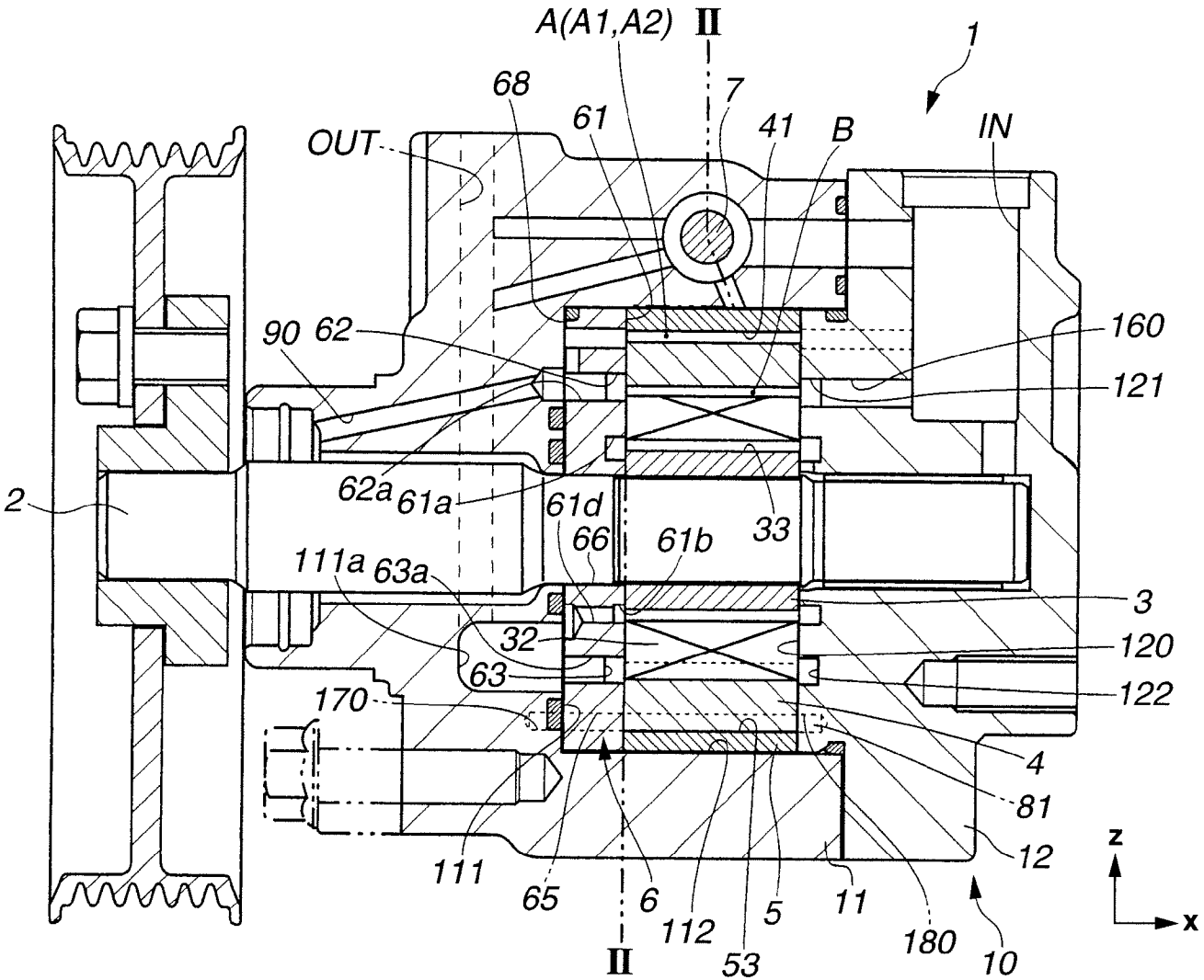
FIG. 1 is an axial sectional view of a vane pump 1 according to a first embodiment of the present invention (taken across a line I-I in FIG. 2).
Figure 2:
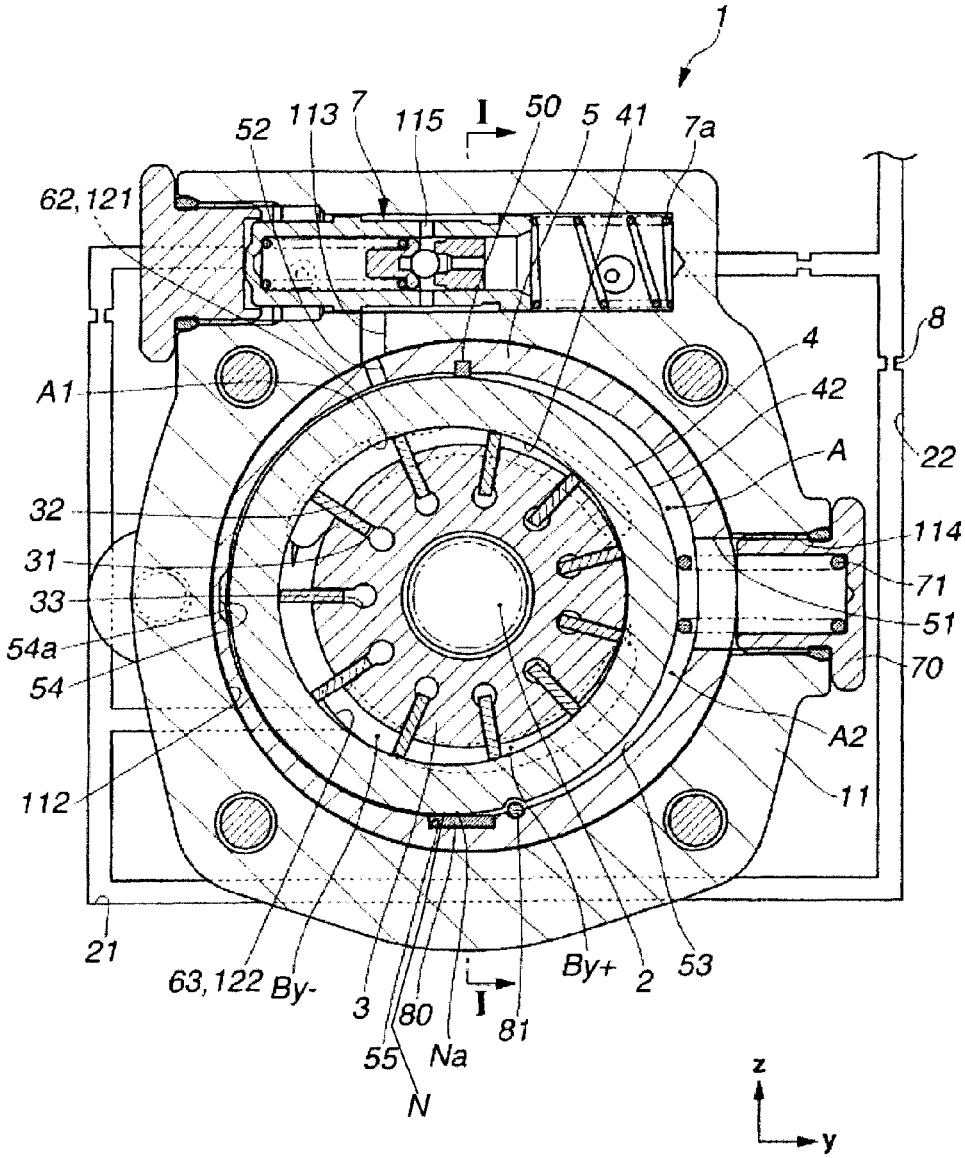
FIG. 2 is a radial sectional view taken across a line II-II shown in FIG. 1.
Figure 3:
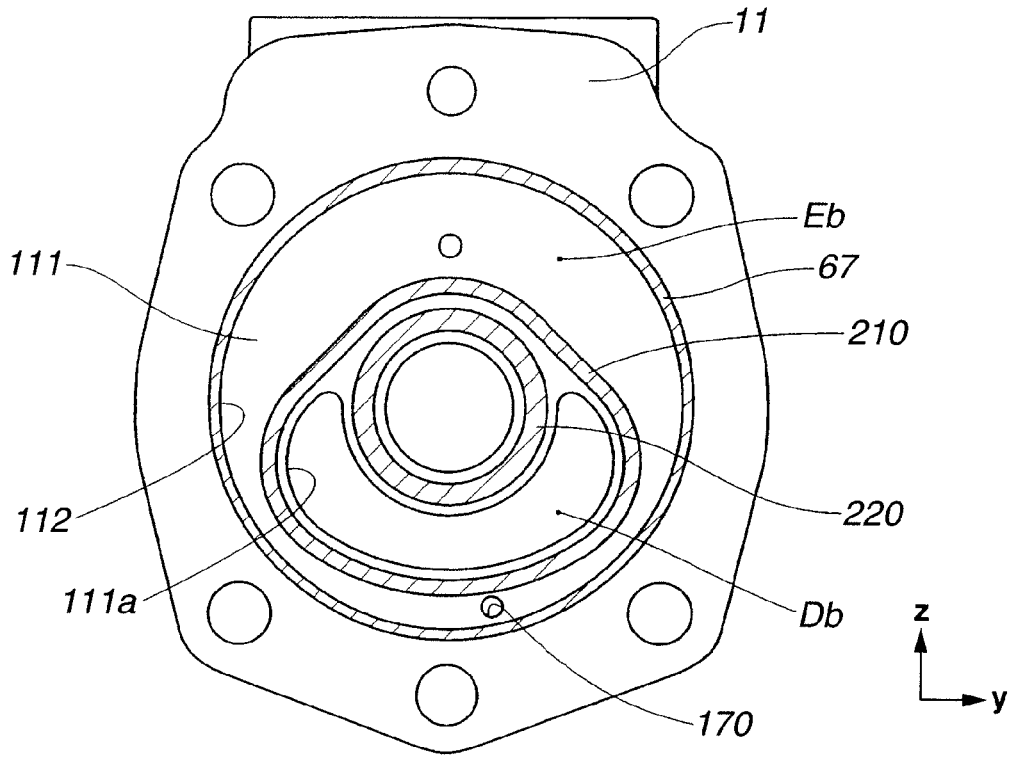
FIG. 3 is a front elevational view of a front body 11 of the vane pump of FIG. 1, showing a positive x side of front body 11.

FIG. 1 shows, in the form of an axial section (taken across a line I-I of FIG. 2), a variable displacement vane pump 1 according to the first embodiment of the present invention. FIG. 2 is a radial section (taken across a line II-II shown in FIG. 1) in a maximum eccentricity state in which a cam ring 4 is shifted most in a negative y direction. FIG. 3 is a front view showing a positive x side of a front body 11 together with seal members 210, 220 and 67.

The following explanation uses an orthogonal coordinate system including an x-axis extending in an axial direction of a drive shaft 2 of the vane pump 1, a y-axis extending in an axial direction of a spring 71 (shown in FIG. 2) for regulating swing motion of cam ring 4, and a z-axis orthogonal to the x-axis and y-axis. A positive x direction (rightward in FIG. 1) is a direction in which drive shaft 2 is inserted into the front body 11 and a rear body 12, and a negative x direction (leftward in FIG. 1) is opposite to the positive x direction. A negative y direction (leftward in FIG. 2) is a direction in which spring 71 urges cam ring 4, and a positive y direction (rightward in FIG. 2) is opposite to the negative y direction. A positive z direction (upward in FIGS. 1 and 2) is a direction toward an inlet passage IN, and a negative z direction (downward in FIGS. 1 and 2) is opposite to the positive z direction.

Vane pump 1 includes drive shaft 2, rotor 3, cam ring 4, an adapter ring 5, and a pump body 10. Drive shaft 2 is adapted to be connected with an engine through a drive having pulleys (such as a belt drive), and arranged to rotate as a unit with rotor 3.

A plurality of slots 31 in the form of axial grooves are formed radially in an outer circumference portion of rotor 3. In each slot 31, a vane 32 is inserted radially so that the vane 32 can move radially in the slot 31. Each slot 31 has a back-pressure chamber 33 formed at the radial inner end of the slot 31, and arranged to urge the corresponding vane 32 in the radial outward direction when an oil pressure is supplied to the back pressure chamber 33.

Pump body 10 is composed of front body 11 and a rear body 12 (corresponding to a first plate member). Front body 11 is shaped like a cup having a bottom (or end wall) 111 and opening toward the positive x side (rightwards in FIG. 1, toward rear body 12). Pressure plate 6 (corresponding to a second plate member) in the form of a circular disk is disposed on bottom 111 in front body 11. Front body 11 includes a circumferential wall which surrounds, and thereby defines, a pump element receiving portion (or inside bore) 112 in front body 11, and an end wall defining bottom 111. Pump element receiving portion 112 of front body 11 contains adapter ring 5, cam ring 4 and rotor 3 on the positive x (right) side of pressure plate 6. Therefore, pressure plate 6 is disposed axially between bottom 111 of front body 11 and the set of adapter ring 5, cam ring 4 and rotor 3.

Rear body 12 abuts, liquid-tightly from the positive x side (from the right side as viewed in FIG. 1), on the adapter ring 5, cam ring 4 and rotor 3. Thus, adapter ring 5, cam ring 4 and rotor 3 are sandwiched axially between pressure plate 6 (second plate member) and rear body 12 (first plate member), and surrounded by the circumferential wall of front body 11.

Pressure plate 6 is formed with a center through hole (or drive shaft hole) 66 through which drive shaft 2 is inserted. Inlet (or intake) ports 62 and 121 and outlet (or discharge) ports 63 and 122 are formed, respectively, in a sliding surface 61 which is a positive x (right) side surface of pressure plate 6 on the positive x side and which is in sliding contact with rotor 3, and a sliding contact surface 120 which is a negative x (left) side surface of rear body 12 on the negative x side and which is in sliding contact with rotor 3. Inlet ports 62 and 121 are connected to an inlet passage IN. Outlet ports 63 and 122 are connected to an outlet opening OUT. Inlet and outlet ports 61, 121, 62 and 122 function to supply and discharge the operating fluid (oil) to and from pumping chambers B formed between rotor 3 and cam ring 4. Inlet ports 62 and 121 are opened in a region (inlet or intake region Bz+) in which the volumes of pumping chambers B are increased. Outlet ports 63 and 122 are opened in a region (outlet or discharge region Bz−) in which the volumes of pump chambers B are decreased.

Rotor 3 and pressure plate 6 are made of different materials. Specifically, pressure plate 6 is made of a material softer than the material of rotor 3. For example, rotor 3 is made of a ferrous material whereas pressure plate 6 is made of aluminum alloy or copper alloy.

Therefore, a softer one of the rotor 3 and pressure plate 6 can serve as cushioning or buffer material to avoid scratching and seizure in case of interference between sliding surface 61 of pressure plate 6 and rotor 3 or bite of a foreign object. Moreover, with an arrangement balancing the pressure acting on pressure plate 6 as mentioned later, the pressure plate 6 of a softer material can perform the function of the cushioning material effectively.

The use of a bearing steel as a base material of pressure plate 6 is effective for preventing seizure. In this case, pressure plate 6 further includes a surface layer of aluminum alloy or copper formed by vapor deposition on the base material, to cover the surfaces of pressure plate 6 (the sliding surface 61 and backup surface 68). The pressure plate 6 including such a surface layer covering the base material is effective for attaining the rigidity and anti-seizure characteristic of pressure plate 6, and for reducing the wall thickness and size.

Adapter ring 5 is an annular member shaped like an ellipse having a major axis along the y-axis and a minor axis along the z-axis. Adapter ring 5 is surrounded by the circumferential wall of front body 11 on the radial outer side or outer circumferential side, and adapter ring 5 surrounds cam ring 4 on the radial inner side or inner circumferential side. A pin member 81 is arranged to prevent rotation of adapter ring 5 relative to front body 11. Therefore, adapter ring 5 does not rotate in front body 11 when the pump is operated.

Cam ring 4 is an annular member shaped like a circle and the outside diameter of cam ring 4 is approximately equal to the minor axis of adapter ring 5. The circular cam ring 4 is received in the elliptical inside bore of adapter ring 5, and there is formed, between the outer circumference of cam ring 4 and the inner circumference 53 of adapter ring 5, an interspace serving as a fluid pressure chamber A. Cam ring 4 can swing in the y-axis direction in adapter ring 5.

A stopper portion 54 is formed in the inner circumference 53 of adapter ring 5 on the negative y (left) side, and arranged to limit movement of cam ring 4 in the negative y direction. On each of opposite sides along the x-axis, stopper portion 54 is formed with a cutout portion 54*a* serving as a connection groove portion for making smooth the communication of the operating fluid between the positive z (upper) side and the negative z (lower) side in a first pressure chamber A1.

A seal member 50 is provided in the inner circumference 53 of adapter ring 5 on the positive z side (the upper side in FIG. 2). A swing support surface N is formed in the inner circumference 53 of adapter ring 5 on the negative z side (the lower side in FIG. 2). At this swing support surface N, adapter ring 5 limits movement of cam ring 4 in the z-axis negative direction.

The swing support surface N is formed by a plate member 80. Fluid pressure chamber (interspace) A is divided into first pressure chamber A1 on the negative y side (the left side in FIG. 2) and a second pressure chamber A2 on the positive y side (the right side in FIG. 2), by the swing support surface N of plate member 80 located on the negative z (lower) side, and seal member 50 located on the positive z (upper) side. The before-mentioned pin member 81 is disposed between cam ring 4 and adapter ring 5, and arranged to prevent rotation of cam ring 4 about drive shaft 2, by being received in a groove formed in the outer circumference of cam ring 4.

Front body 11 and rear body 12 are formed, respectively, with pin holes 170 and 180, and pressure plate 6 is formed with a pin through hole 65 extending in the x-axis direction through pressure plate 6. Pin member 81 is inserted in these pin holes 170, 180 and 65. Pin holes 170, 180 and 65 are elongated in cross section, and the pin member 81 can move within the elongated cross sections of these pin holes (cf. FIGS. 4 and 5). When a load is applied to pin member 81 from cam ring 4, the elongated pin holes allow pin member 81 to move within the elongated cross section and thereby prevent bending deformation of pin member 81. Pin member 81 is inserted through pressure plate 6 and supported at both ends by pin hole 170 of front body 11 and pin hole 180 of rear body 12. This structure can support pressure plate 6 reliably and prevent rotation of cam ring 4 reliably.

The outside diameter of rotor 3 is smaller than the inside diameter of the inside circumferential surface 41 of cam ring 4. Rotor 3 having the smaller outside diameter is thus received in cam ring 4 having the larger inside diameter. The rotor 3 is designed so that the outer circumference of rotor 3 does not abut on the inner or inside circumferential surface 41 of cam ring 4 even if cam ring 4 swings, and the rotor 3 and cam ring 4 move relative to each other.

When cam ring 4 is swung most to the negative y (left) side, the distance between the inner circumferential surface 41 of cam ring 4 and the outer or outside circumferential surface of rotor 3 is greatest on the negative y side. When cam ring 4 is swung most to the positive y (right) side, the distance L is smallest on the positive y (right) side.

Vanes 32 are mounted on rotor 3 and arranged radially. The radial length of each vane 32 is greater than the maximum value of the distance L between the inner circumferential surface 41 of cam ring 4 and the outer circumferential surface of rotor 3. Accordingly, irrespective of changes in the relative position between cam ring 4 and rotor 3, each vane 32 remains in the state in which a radial inner portion of the vane 32 is received in the corresponding slot 31 of rotor 3, and a radial outer portion of the vane 32 abuts on the inner circumferential surface 41 of cam ring 4. Each vane 32 always receives the back pressure in the corresponding back pressure chamber 33, and abuts on the inner circumference surface 41 of cam ring 4 liquid-tightly. Therefore, in the annular space between cam ring 4 and rotor 3, adjacent two of vanes 32 define a pumping chamber B liquid-tightly. The volume of each pumping chamber B is varied with rotation of rotor 3 when rotor 3 and cam ring 4 are held in an eccentric state as the result of the swing motion of cam ring 4.

Inlet ports 62 and 121 and outlet ports 63 and 122 formed in pressure plate 6 and rear body 12 are extended curvilinearly along the outer circumference of rotor 3 and arranged to supply and drain the operating fluid to and from each pumping chamber B in accordance with decrease and increase of the volume of each pumping chamber B.

First and second seal members 210 and 220 are provided on backup surface 68 of pressure plate 6 (cf. FIG. 3). This backup surface 68 is a negative x (left) side surface of pressure plate 6. Pressure plate 6 includes two opposite surfaces, one being the before-mentioned sliding surface 61 facing in the positive x direction toward rotor 3, and the other being this backup surface 68 facing in the negative x direction, away from rotor 3. First seal member 210 extends on the radial inner side or inner circumferential side of inlet port 62, and on the radial outer side or outer circumferential side of outlet port 63. Second seal member 220 is located on the radial inner side of inlet and outlet ports 62 and 63 and on the radial outer side of drive shaft 2. First and second seal members 210 and 220 define a backup-side higher pressure region Db and a backup-side lower pressure region Eb as explained more in detail later. Backup-side higher pressure region Db is formed between first and second seal members 210 and 220. Backup-side lower pressure region Eb is formed on the radial outer side of first seal member 210 (and on the radial inner side of second seal member 220). A third seal member 67 is provided in an outermost circumferential region of pressure plate 6.

Each of first and second seal members 210 and 220 is in the form of a closed shape like a closed plane figure. Second seal member 220 is circular whereas first seal member 210 is noncircular (or guitar-shaped). First seal member 210 includes an inner (inlet-side) segment extending on the radial inner side of inlet port 62, an outer (outlet-side) segment extending on the radial outer side of outlet port 63, a first crossover (intermediate) segment connecting ends of the inner and outer segments on a first (negative y) side and a second crossover (intermediate) segment connecting ends of the inner and outer segments on a second (positive y) side.

An inlet-side vane backpressure groove 61*a* and an outlet-side vane backpressure groove 61*b* are formed in sliding surface 61 of pressure plate 6, and arranged to supply the discharge pressure to backpressure chambers 33 for vanes 32. Backpressure grooves 61*a* and 61*b* are connected by a connecting groove 61*c* (cf. FIG. 4). Outlet-side backpressure groove 61*b* is connected through a fluid passage 61*d* (shown in FIG. 4 and FIG. 1) formed in pressure plate 6, with a discharge pressure introduction groove 111*a* (shown in FIG. 1) formed in bottom 111 of front body 11.

A radial through hole 51 is formed in adapter ring 5 on the positive y side. A plug insertion hole 114 is formed in front body 11 on the positive y side. A plug member 70 shaped like a cup having a bottom is inserted in the plug insertion hole 114 of front body 11, and arranged to seal the inside of the pump body liquid-tightly.

The before-mentioned spring 71 is received in plug member 70 so that spring 71 can extend and compress in the y-axis direction. Spring 71 extends through radial through hole 51 of adapter ring 5, and abuts on cam ring 4. This spring 71 urges cam ring 4 in the negative y direction toward the swing position at which the cam ring 4 is swung to the greatest extent and the eccentricity is maximum, and thereby stabilizes the discharge quantity (the swing position of cam ring 4) in a pump starting operation in which the pressure is unstable.

[Supply of operating fluid to first and second pressure chambers] A through hole 52 is formed in a positive z side portion (or upper portion) of adapter ring 5 at a position on the negative y side of seal member 50 (on the left side of seal member 50 as viewed in FIG. 2). This through hole 52 is connected, through a fluid (oil) passage 113 formed in front body 11, with a control valve 7. Through hole 52 connects the first pressure chamber A1 on the negative y side, with control valve 7. Fluid passage 113 opens to a valve receiving bore 115 containing a valve element of control valve 7. In a pump driving operation, a control pressure Pv is introduced into first fluid pressure chamber A1. Control valve 7 serves as a pressure controlling means.

Control valve 7 is connected with outlet ports 63 and 122 through fluid passages 21 and 22. An orifice 8 is provided in fluid passage 22. Control valve 7 receives the outlet (discharge) pressure on the upstream side of orifice 8 and an orifice downstream pressure on the downstream side of orifice 8. Being operated by a pressure difference between the outlet pressure and the orifice downstream pressure and a valve spring 7*a*, the control valve 7 produces a control pressure.

The control pressure is introduced into first fluid pressure chamber A1. Since the control pressure is produced in accordance with inlet pressure and outlet pressure, the control pressure is higher than or equal to the inlet pressure.

The inlet (suction) pressure is introduced into second fluid pressure chamber A2 through a lower pressure supply passage 160 shown in FIG. 1. This supply passage 160 extends in rear body 12, from inlet passage IN to the negative x side surface 120 of rear body 12, and thereby connects inlet passage IN with second fluid pressure chamber A2. Lower pressure supply passage 160 is always opened to second fluid pressure chamber A2 irrespective of changes in the swing position of cam ring 4.

Vane pump 1 of this example is arranged to supply the inlet pressure invariably to second pressure chamber A2, and to control only the fluid pressure P1 in first pressure chamber A1 is always supplied with the inlet pressure. The pressure P2 in second pressure chamber A2 is held equal to the inlet pressure without being varied. Thus, by maintaining the stable pressure for second pressure chamber A2, the vane pump 1 can control the swing motion of cam ring 4 stably without being affected by disturbance in the oil pressure.

[Swing motion of cam ring] When the force in the positive y direction applied to cam ring 4 from the pressure P1 in first pressure chamber A1 becomes greater than the sum of the force due to the pressure P2 in second pressure chamber A2 and the force of spring 71, then cam ring 4 swings about the rotation axis set at plate member 80, in the positive y direction. By this swing motion, the volumes of pumping chambers By+ on the positive y side are increased and the volumes of pumping chambers By− on the negative y side are decreased.

With the decrease in the volumes of pumping chambers By− on the negative y side, the quantity of fluid supplied per unit time from the inlet ports 62 and 121 to the outlet ports 63 and 122 becomes smaller, and the pressure difference between the upstream pressure and downstream pressure of orifice 8 becomes smaller.

Accordingly, control valve 7 is pushed back by valve spring 7*a*, and the control pressure of control valve 7 is decreased. Consequently, the pressure P1 of first pressure chamber A1 becomes lower, and cam ring 4 swings in the negative y direction when the sum of the forces in the negative y direction becomes greater than the opposing force.

When the forces in the positive y direction and the negative y direction are substantially equal to each other, cam ring 4 becomes stationary in the balance of forces in the y direction. Accordingly, the fluid quantity increases, and the pressure difference between both sides of orifice 8 increases, and control valve 7 increases the valve control pressure by pushing valve spring 7*a*.

Therefore, cam ring 4 swings in the positive y direction. In practice, the quantity of eccentricity of cam ring 4 is determined so as to hold the flow quantity set by the orifice diameter of orifice 8 and the spring 7*a* constant with no hunting in the swing motion.

Figure 4:
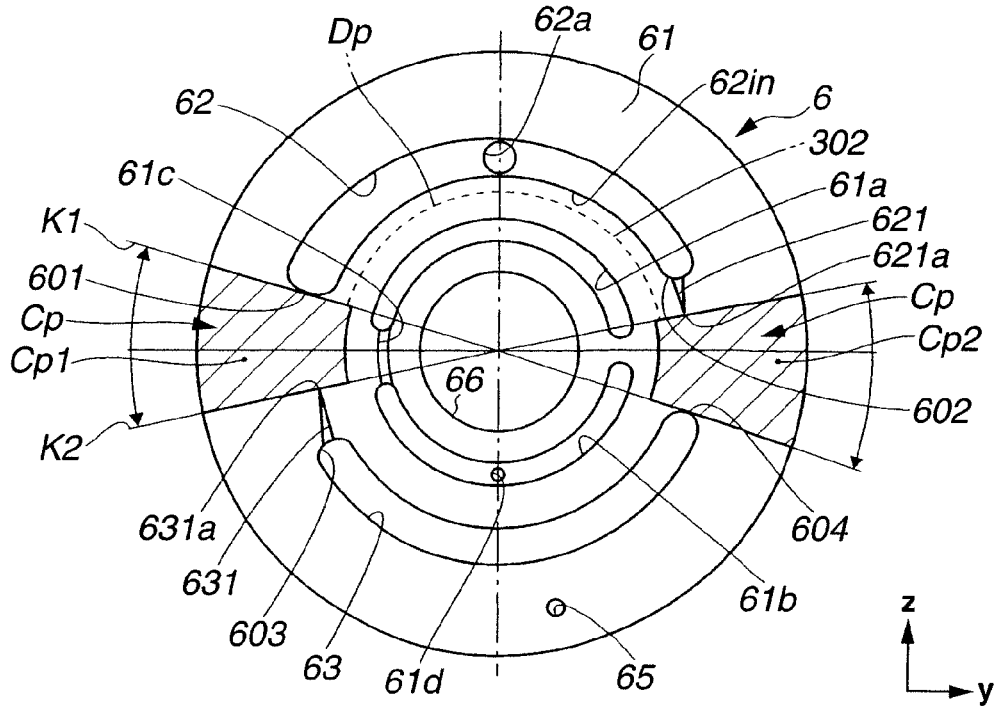
FIG. 4 is a front elevational view of a pressure plate 6 of the vane pump of FIG. 1, showing the positive x side of pressure plate 6.

[Pressure distribution in pressure plate] FIG. 4 shows the sliding surface 61 of pressure plate 6 facing in the positive x direction. To the backup surface 68 which is the opposite side surface opposite to sliding surface 61, the outlet (discharge) pressure is introduced from outlet port 63 through a fluid passage 63*a* (cf. FIG. 1). The outlet pressure is introduced to the negative z side of bottom 111 of front body 11 through outlet pressure introduction groove 111*a* (cf. FIG. 3) formed in bottom 111 of front body 11.

The introduced outlet pressure between bottom 111 and pressure plate 6 pushes the pressure plate 6 toward rotor 3 (in the positive x direction), and thereby reduces the clearance between rotor 3 and pressure plate 6 to restrain the leakage. The outlet pressure is further introduced through a fluid passage 61*d* to the inlet-side and outlet-side backpressure grooves 61*a* and 61*b*, and used to urge vanes 32 radially outwards.

Sliding surface 61 of pressure plate 6 is a surface forming the pumping chambers B with rotor 3 and vanes 32. Therefore, regions between inlet and outlet ports 62 and 63 serve as a closure region Cp (shown by hatching in FIG. 4) for closing the pumping chambers B and allowing changeover between the inlet pressure and outlet pressure.

Each of leading ends 602 and 603 of inlet port 62 and outlet port 63 is formed with a notch groove 621 or 631. In FIG. 4, a line K1 is a straight line connecting trailing ends 601 and 604 of inlet port 62 and outlet port 63, and a line K2 is a straight line connecting forward ends 621*a* and 631*a* of the notch grooves 621 and 631. The closure region Cp is enclosed by these lines K1 and K2 and an outer circumferential line 302 (as explained later) of a rotor-side discharge region Dp on the positive z side.

The outer circumferential line 302 on the positive z side is a center line between an inner circumferential line 62 in of inlet port 62 and an outer circumference (or peripheral border) of inlet-side backpressure groove 61*a*, in this example. An outer circumference (peripheral border) line 305 of closure region Cp is a center line between the inner circumference (peripheral border) 41 and outer circumference (peripheral border) 42 of cam ring 4.

The closure region Cp includes a first closing region Cp1 on the negative y side and a second closing region Cp2 on the positive y side. In first closing region Cp1, the pressure is changed from the inlet pressure to the outlet pressure. In second closing region Cp2, the pressure is changed from the outlet pressure to the inlet pressure.

To improve the pressure balance in pressure plate 6, a backup-side higher pressure region Dp is defined (as explained later) on backup surface 68 on the basis of the closure region Cp on sliding surface 61 where the pressure is changed between the inlet pressure and outlet pressure.

Straight lines K1 and K2 represent imaginary flat planes extending in the axial direction of pressure plate 6 (along the x axis). In the example of FIG. 4, each of straight lines K1 and K2 passes through a center (OR shown in FIG. 5) representing a center axis of pressure plate 6. The above-mentioned imaginary flat planes intersect each other along this center axis (OR). Each of first and second closing regions Cp1 and CP2 extends circumferentially in a sectorial portion so defined between the straight lines (or the imaginary flat planes) K1 and K2 that neither inlet port 62 nor outlet port 63 is formed in the sectorial portion.

Figure 5:
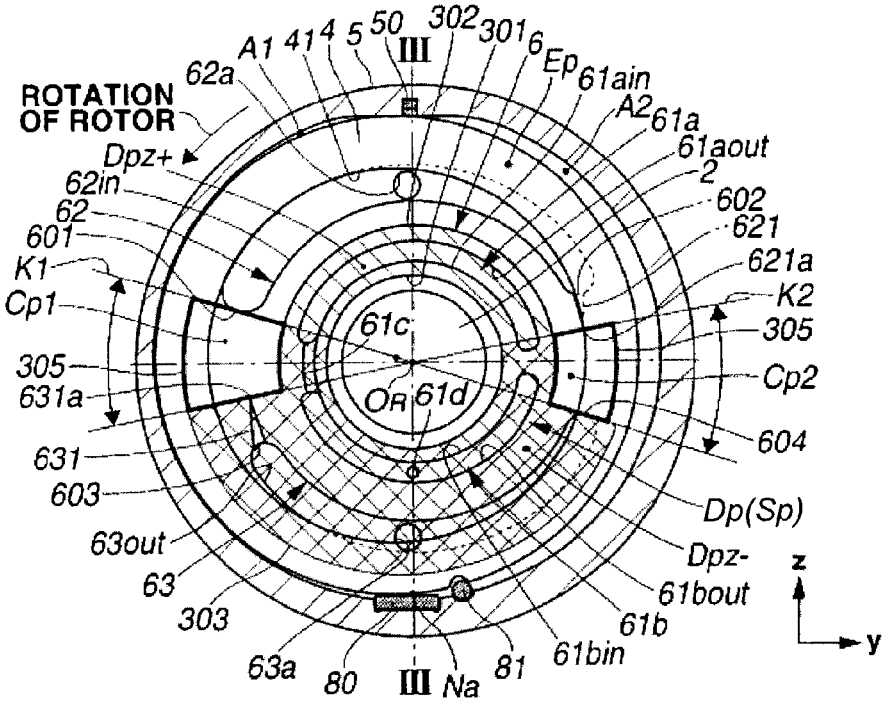
FIG. 5 is a view showing a pressure distribution of a pump outlet pressure (or discharge pressure) and a pump inlet pressure (or intake pressure) in a sliding surface 61 of the pressure plate 6.

FIG. 5 shows the pressure distribution (Ep, Dp) in sliding surface 61 of pressure plate 6, together with cam ring 4 and adapter ring 5. First and second closing regions Cp1 and Cp2 are shown by heavy lines. Sliding surface 61 includes regions directly bared in the pumping chambers B, as a wall surface axially bounding the pumping chambers B. Therefore, sliding surface 61 includes a rotor-side discharge region Dp (a cross-hatched region and a hatched region) which bounds the pumping chambers B communicating with outlet port 63, and hence receives the outlet (discharge) pressure, and a rotor-side suction region Ep which bounds the pumping chamber B communicating with inlet port 62 and hence receives the inlet (suction) pressure. Rotor-side suction region Ep is a region remaining after rotor-side discharge region Dp is taken away from sliding surface 61.

The outlet pressure is introduced to inlet-side backpressure groove 61*a* through outlet pressure introduction groove 111*a* formed in bottom 111 of front body 11, and outlet-side backpressure groove 61*b*. Therefore, the outlet pressure is applied around inlet-side backpressure groove 61*a*, and the rotor-side discharge region Dp includes a positive z side discharge region Dpz+ (shown by hatching) extending along the inlet-side backpressure groove 61*a*.

This positive z side discharge region Dpz+ is bounded radially between an inner circumferential (peripheral border) line 301 and an outer circumferential (peripheral border) line 302. This inner circumferential line 301 is a center line between the inner circumferential line 61*a* in of inlet-side backpressure groove 61*a* and the outer circumference of center drive shaft hole 66. Outer circumferential line 302 is a center line between the outer circumference line 61*a* out of inlet-side backpressure groove 61*a* and the inner circumferential line 62 in of inlet port 62. In this example, inner circumferential line 301 is an arc of a circle around center drive shaft hole 66, and this circle further defines an inner circumference of a later-mentioned negative z side discharge region (or subregion) Dpz−.

In addition to the positive z side discharge region Dpz+, the rotor-side discharge region Dp further includes a negative z side region (or subregion)(shown by cross hatching) including a first intermediate region on the radial inner side of first closing region Cp1, a second intermediate region on the radial inner side of second closing region Cp2, and a broad region covering outlet port 63 and outlet-side backpressure groove 61*b*. Moreover, it is possible to consider that the rotor-side discharge region Dp is composed of an annular inner region covering the inlet-side and outlet-side backpressure grooves 61*a* and 61*b* and encircling the center hole 66, and an outer region covering the outlet port and extending only in a sector in which the outlet port is formed.

The negative z side discharge region Dpz− is bounded on the radial inner side by the inner circumference line (circle) 301 which is a center line between the inner circumferential line 61*b* in of outlet-side backpressure groove 61*b* and the outer circumference of center drive shaft hole 66.

The outer circumferential line 303 of negative z side discharge region Dpz− extends along outlet port 63 on the radial outer side of outlet port 63. Outer circumferential line 303 of negative z side discharge region Dpz− of this example is a center line between the inner and outer circumferences 41 and 42 of cam ring 4 in a portion where the outlet port 63 does not overlap with the cam ring 4, and a center line between the outer circumference line 63 out of outlet port 63 and the outer circumference 42 of cam ring 4 in a portion where the outlet port 63 overlaps with the cam ring 4.

Thus, the area Sp of rotor-side discharge region Dp is equal to the area of a figure bounded by inner circumferential line 301 and outer circumferential lines 302 and 303.

Figure 6:
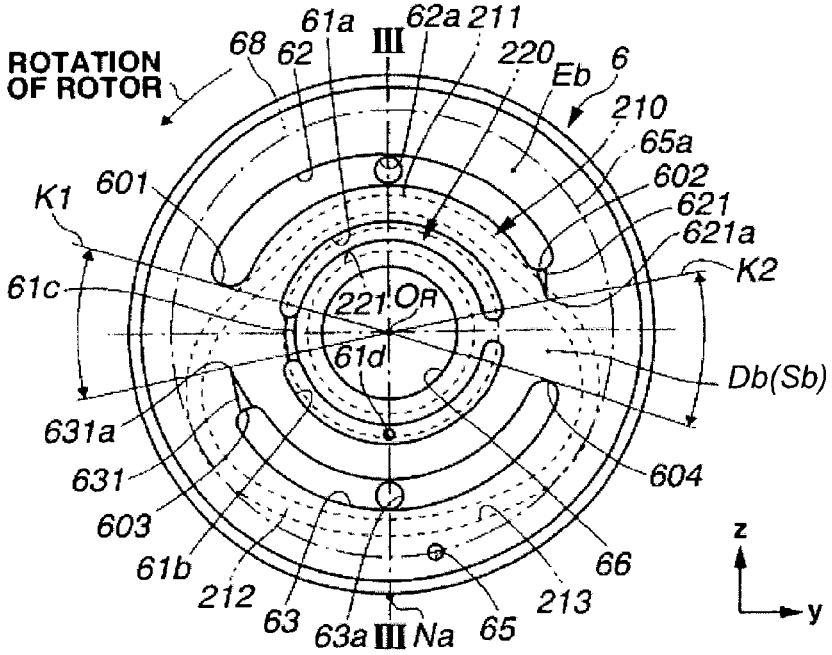
FIG. 6 is a view showing first and second seal members 210 and 220 by broken lines as projected on the sliding surface 61 or as viewed from the positive x side.

FIG. 6 shows first and second seal members 210 and 220 by broken lines in sliding surface 61, as projected figures projected on sliding surface 61. First and second seal members 210 and 220 are bilateral symmetrical with respect to a median line III-III (representing a median plane) bisecting inlet port 62 and outlet port 63. The projection of second seal member 220 encloses the center drive shaft hole 66. The projection of first seal member 210 encloses the center drive shaft hole 66, outlet-side backpressure groove 61*b* and outlet port 63.

First seal member 210 encloses second seal member 220, and defines a backup-side higher pressure region Db between first and second seal members 210 and 220 in backup surface 68. The outlet pressure is introduced to this backup-side higher pressure region Db through a fluid passage 63*a* opened in outlet port 63 located in the backup-side higher pressure region Db as viewed in FIG. 6.

A backup-side lower pressure region Eb is defined around first seal member 210 so that first seal member 210 is surrounded by backup-side lower pressure region Eb. The inlet pressure is introduced to this backup-side lower pressure region Eb through a fluid passage or through hole 62*a* opened in inlet port 62 located in the backup-side lower pressure region Eb as viewed in FIG. 6.

Since first and second seal members 210 and 220 are pushed by the fluid pressure, the area Sb of backup-side higher pressure region Db additionally includes the areas of first and second seal members 210 and 220. Thus, the area Sb of backup-side higher pressure region Db is the area of a figure enclosed by an outer circumferential line 213 of first seal member 210 and an inner circumferential line 221 of second seal member 220.

Figure 7:
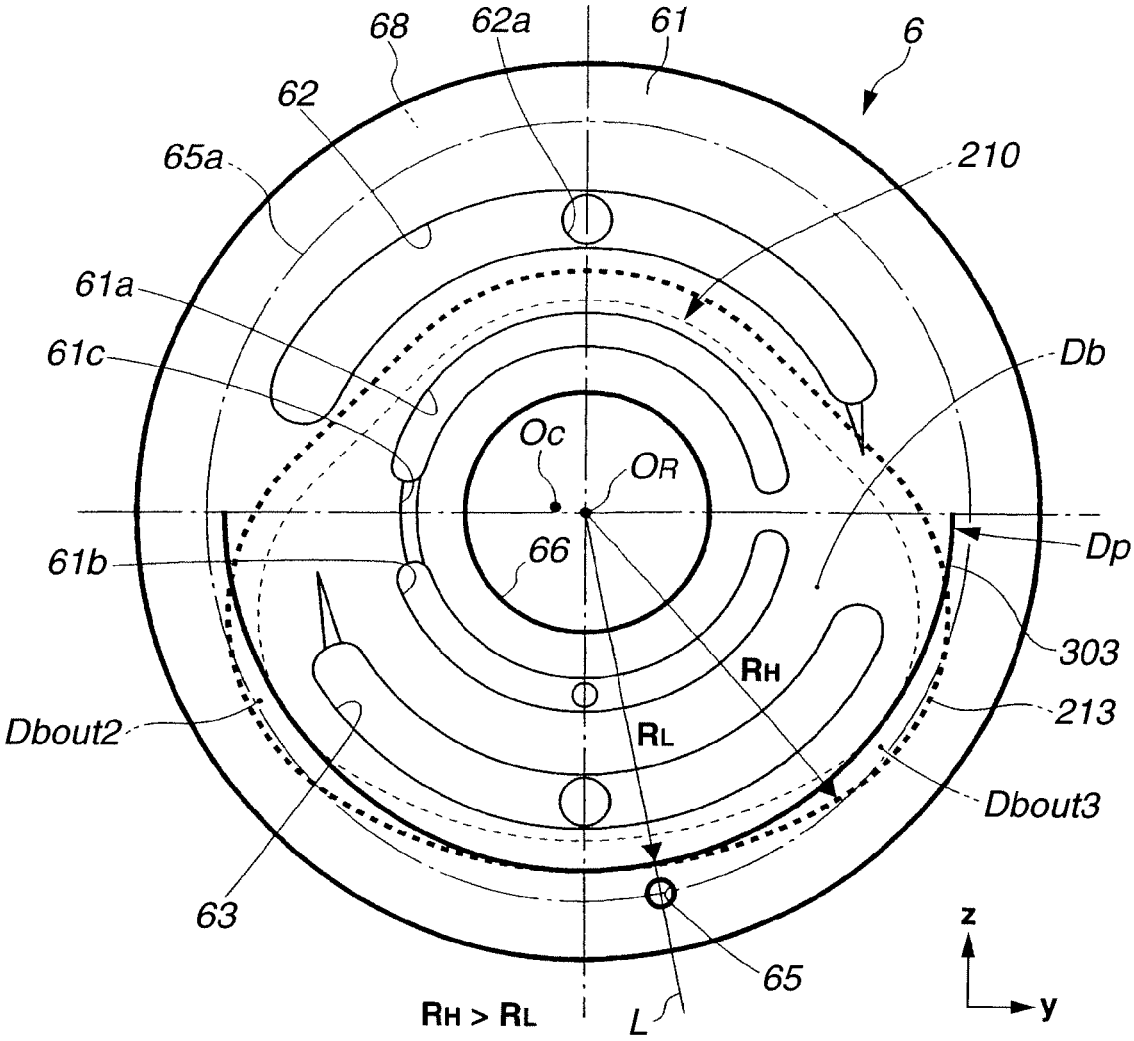
FIG. 7 is a view showing a rotor-side discharge region Dp in the sliding surface 61 together with the first seal member 210, on a negative z side.

In sliding surface 61, the projection of first seal member 210 encloses inlet-side backpressure groove 61*a*, but does not enclose inlet port 62 (cf. FIG. 7). Therefore, first seal member 210 includes a positive z side segment 211 extending between inlet port 62 and inlet-side backpressure groove 61*a*, and a negative z side segment 212 extending on the radial outer side of outlet port 63.

FIG. 7 shows the positional relationship between first seal member 210 and rotor-side discharge region Dp on the negative z side. In FIG. 7, second seal member 220 is omitted, and first seal member 210 and backup-side higher pressure region Db are shown by broken lines.

Pin hole 65 is not enclosed by first seal member 210. First seal member 210 is located on the radial inner side of pin hole 65 along a straight line L connecting the center axis OR of center drive shaft hole 66 or the drive shaft 2 and the pin hole 65. Thus, pin hole 65 is located in the backup side lower pressure region Eb (outside the backup side higher pressure region Db). Therefore, first seal member 210 can prevent leakage of the outlet pressure through pin hole 65, and improve the pump efficiency.

First seal member 210 crosses a circle 65*a* having the center at the axis OR of center drive shaft hole 66, and passing through pin hole 65 as shown in FIG. 7, on both sides of pin hole 65 along circle 65*a*. The outer circumferential line 213 of first seal member 210 bulges radially outwards beyond the negative z side outer circumferential line 303 of rotor-side discharge region Dp on both sides of pin hole 65.

Therefore, the radial distance of outer circumference (or peripheral border) 213 of first seal member 210 from the center OR is increased from a smaller value RL on the radial straight line L extending through the center OR and the pin hole 65, to a greater value RH at an angular position away from the line L. With this noncircular outline, the first seal member 210 can improve the pump efficiency by preventing the higher pressure contained in first seal member 210 from leaking through pin hole 65.

Figure 8:
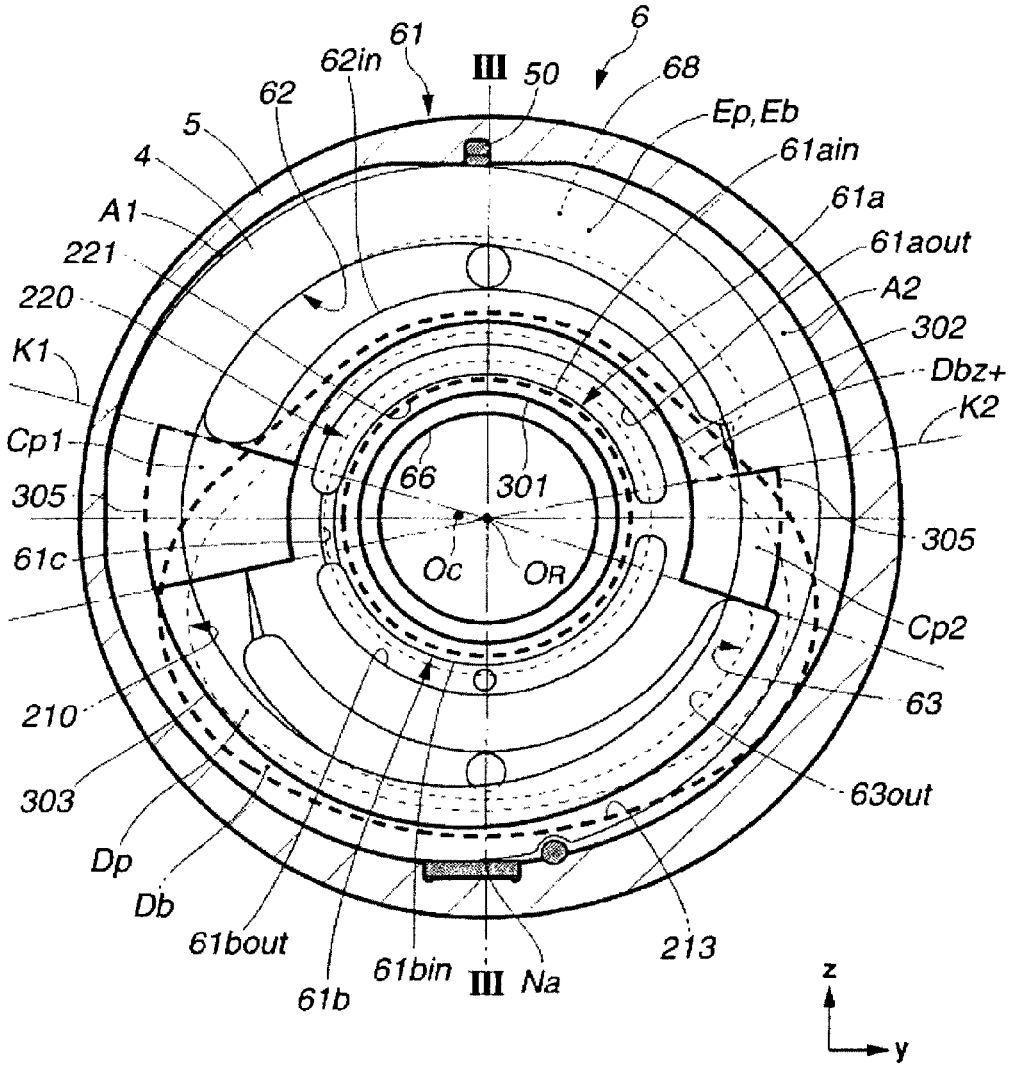
FIG. 8 is a view obtained by combining FIGS. 5 and 6 (adding the first and second seal members 210 and 220 in FIG. 5).
Figure 9:
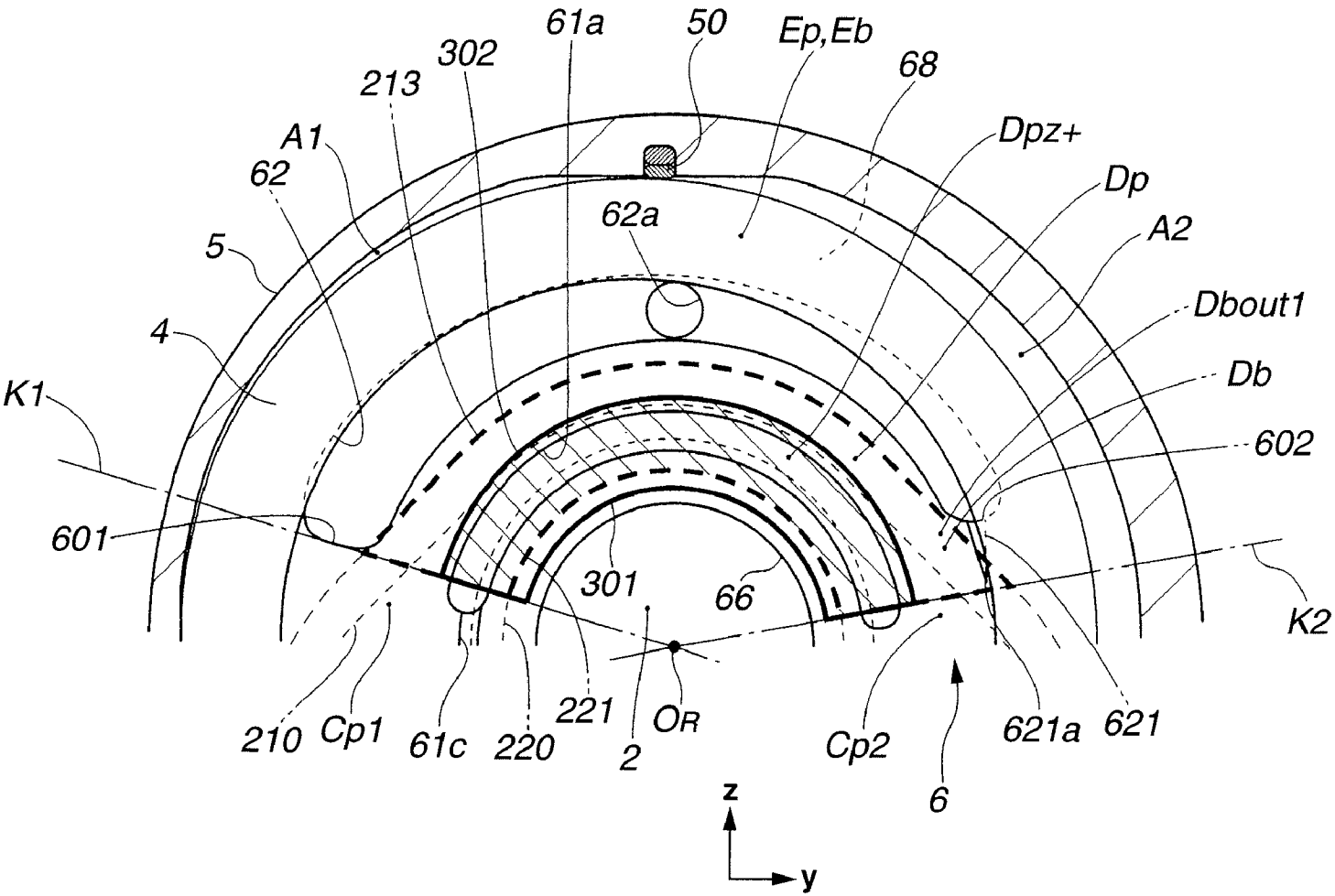
FIG. 9 is an enlarged view showing a positive z side portion of the sliding contract surface 61 of pressure plate 6.

FIG. 8 is a view obtained by incorporating FIG. 6 into FIG. 5 (adding first and second seal members 210 and 220), and FIG. 9 is an enlarge view showing the positive z side portion of sliding surface 61 of pressure plate 6. In FIG. 9, the positive z side discharge region Dpz+ of the rotor-side discharge region Dp is shown by hatching. The backup-side higher pressure region Db is a region formed in backup surface 68 on the opposite side to sliding surface 61. Therefore, in FIG. 8, the backup-side higher pressure region Db is shown as a projection on sliding surface 61.

A projection line of first seal member 210 is located on the radial outer side of outer circumferential line 61*a* out of inlet-side backpressure groove 61*a*. Therefore, the projection of backup-side higher pressure region Db extends to the radial outer side of inlet-side backpressure groove 61*a*. The projection line of first seal member 210 extends to the radial outer side of the positive z side discharge region Dpz+ of rotor-side discharge region Dp and thereby forms a first outer projecting region Dbout1 projecting radially outwards beyond the positive z side discharge region Dpz+. The outlet pressure supplied to the backup-side higher pressure region Db is also applied to this first outer projecting region Dbout1. First seal member 210 is so shaped as to form first outer projecting region Dbout1 on backup surface 68 at the position opposing the inlet-side backpressure groove 61*a*, and to improve the pressure balance with the outlet pressure applied on the first outer projecting region Dbout opposing to the outlet pressure supplied to inlet-side backpressure groove 61*a* on the rotor-side sliding surface 61. The first outer projecting region Dbout1 extends circumferentially on both sides of the median plane III-III containing the center axis OR and bisecting the inlet and outlet ports 62 and 63 in a manner of bilateral symmetry.

Backup-side higher pressure region Db further encloses inlet-side backpressure groove 61*a* and outlet-side backpressure groove 61*b*. The second seal member 220 has the radial width extending from the outer circumference (or peripheral border) of second seal member 220 which is located on the radial outer side of the inner circumference (or peripheral border) of inlet-side backpressure groove 61*a*, to the inner circumference (or peripheral border) of second seal member 220 which is located on the radial inner side of the inner circumference of inlet-side backpressure groove 61*a*.

Center hole 66 is opened, at the center of pressure plate 6, for receiving drive shaft 6, so that the deformation quantity due to pressure tends to become great around center drive shaft hole 66. Moreover, the inlet pressure is applied to an inner region surrounded by backpressure grooves 61*a* and 61*b*. Therefore, in backup surface 68, there is formed, around center hole 66, a backup-side lower pressure annular region (Eb) within second seal member 220 by setting the inside diameter of second seal member 220 greater than the diameter of center hole 66. Second seal member 220 is so sized as to, increase the area of backup lower pressure region Eb and to decrease the area of backup higher pressure region Db around center hole 66 to restrain deformation around center hole 66 by restraining the pressure applied around center hole 66. Thus, backup-side lower pressure region Eb includes an outer subregion formed outside first seal member 210 and an inner subregion formed inside second seal member 220.

Figure 10:
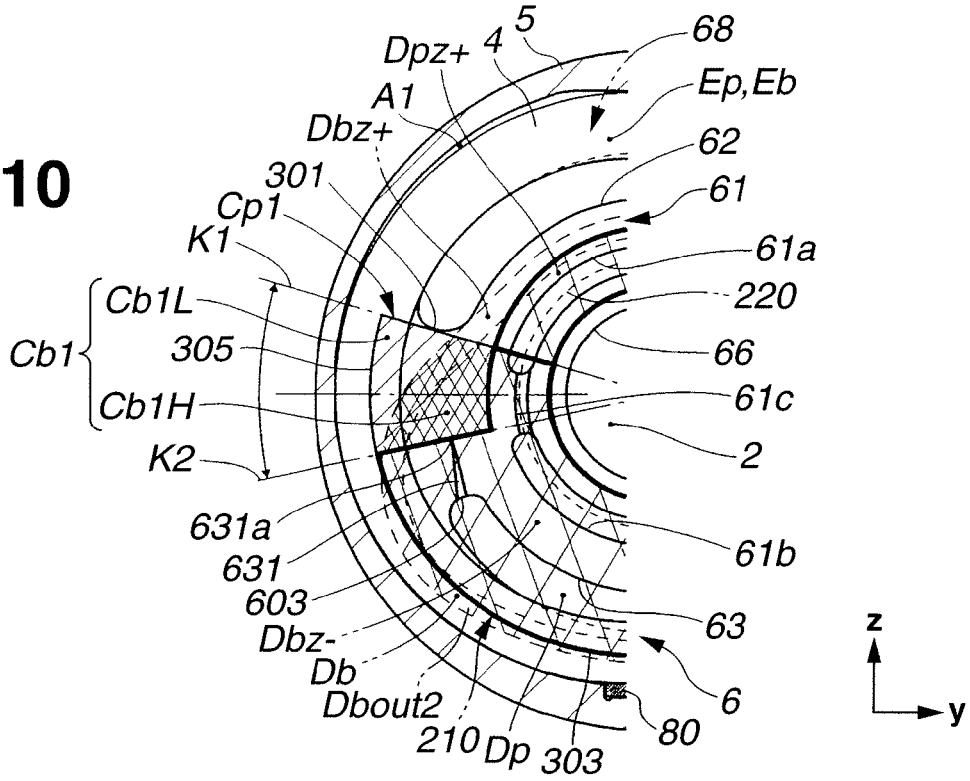
FIG. 10 is an enlarged view showing a part of the sliding surface 61 (to show the vicinity of a first closing region Cp1).
Figure 11:
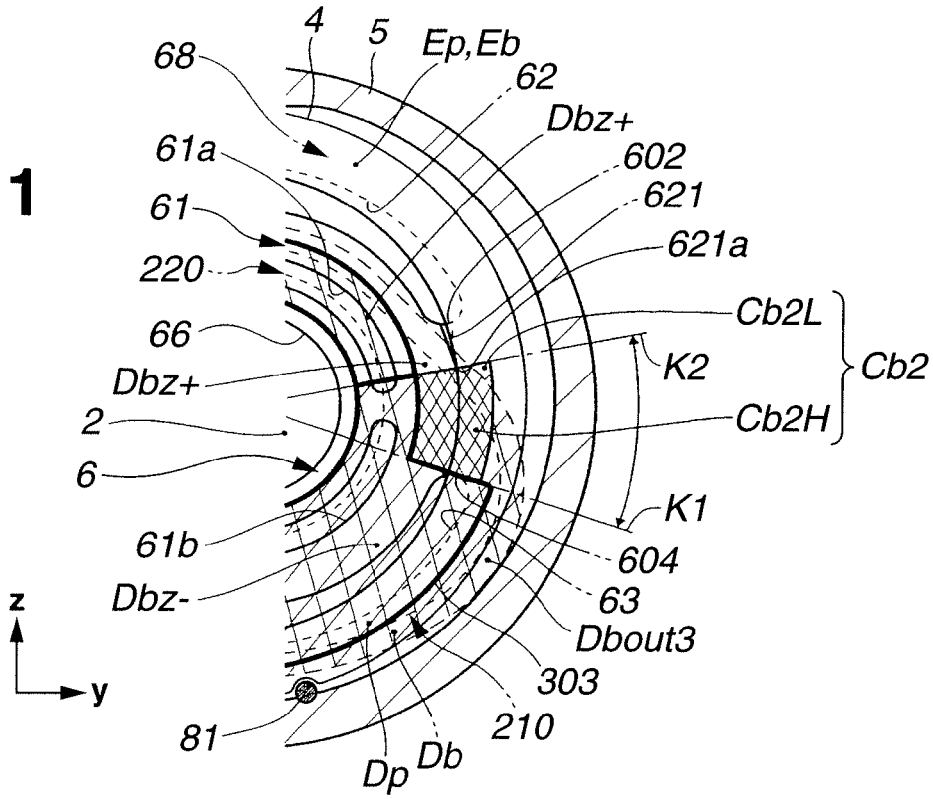
FIG. 11 is an enlarged view showing a part of the sliding surface 61 (to show the vicinity of a second closing region Cp2).

FIGS. 10 and 11 are enlarged views, respectively, showing halves of the pressure plate's sliding surface 61 on the negative y side and positive y side to show the vicinities of first and second closing regions Cp1 and Cp2. Regions Cb1 and Cb2 are first and second projection regions defined, respectively, by projecting first and second closing regions Cp1 and Cp2 on backup surface 68. As in FIG. 8, the backup-side higher pressure region Db is shown by broken lines as the projection on contact surface 61, and the rotor-side discharge region Dp in sliding surface 61 is shown by heavy lines.

In backup surface 68, each of the first and second projection regions Cb1 and Cb2 is divided into a higher pressure subregion Cb1H or Cb2H (shown by cross-hatching) and a lower pressure subregion Cb1L or Cb2L (shown by hatching) by first seal member 210 extending through each of first and second projection regions Cb1 and Cb2. Higher pressure subregions Cb1H or Cb2H are located within first seal member 210, as parts of backup-side higher pressure region Db. Lower pressure subregions Cb1L or Cb2L are located outside the first seal member 210, as parts of backup-side lower pressure region Eb.

In the example shown in FIGS. 10 and 11, the higher pressure subregion Cb1H is broader than the lower pressure subregion Cb1L in first projection region Cb1, and the area Sb1H of higher pressure subregion Cb1H is greater than a half of the area Sb1 of first projection region Cb1. Similarly, the higher pressure subregion Cb2H is broader than the lower pressure subregion Cb2L in second projection region Cb2 of this example, and the area Sb2H of higher pressure subregion Cb2H is greater than a half of the area Sb2 of second projection region Cb2.

When each of pumping chambers B passes through first or second closing regions Cp1 or Cp2 of sliding surface 61, the pressure is changed by changeover between suction and discharge, and this pressure change tends to cause deformation of pressure plate 6 toward the backup side (to the negative x side), and thereby to cause scratching and abrasion. In this case, the higher pressure subregions Cb1H and Cb2H defined just on the opposite side of first and second closing regions Cp1 and Cp2 function to urge pressure plate 6 toward rotor 3 (in the positive x direction) with the outlet pressure in backup higher pressure region Db against the pressures in pumping chambers B, and thereby to restrain deformation of pressure plate 6 by cancelling forces in the x direction.

Higher pressure subregions Cb1H and Cb2H made greater in area than lower pressure subregions Cb1L and Cb2L are effective for improving the balance in forces along the x axis and for preventing undesired deformation of pressure plate 6. Moreover, the arrangement to push pressure plate 6 from the backup side (the negative x side) is effective to reduce the clearance between pressure plate 6 and rotor 3, and thereby improve the pump efficiency by reducing leakage.

Figure 12:
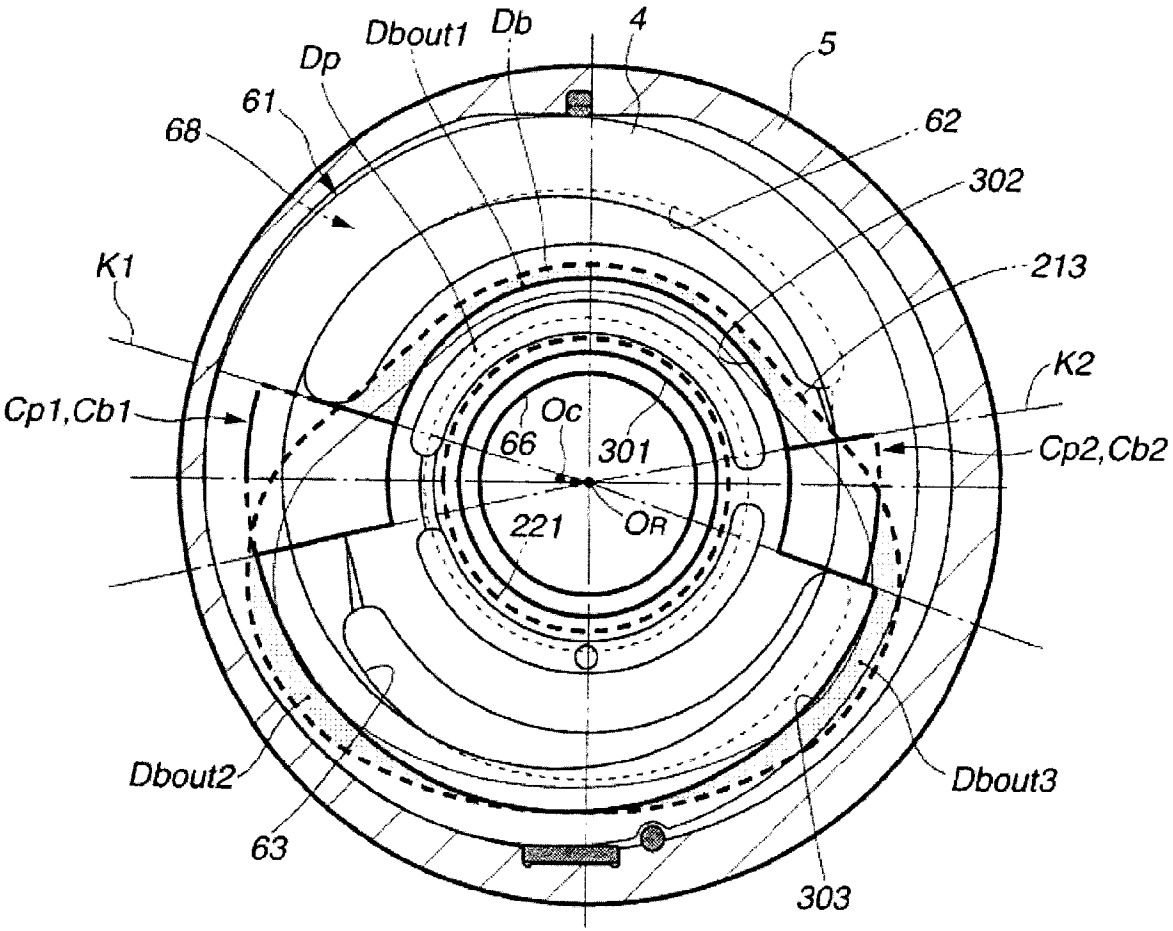
FIG. 12 is a view showing a backup-side higher pressure region Db in comparison with the rotor-side discharge region Dp.

FIG. 12 is a view for showing the rotor-side discharge region Dp on the positive x side and the backup-side higher pressure region Db on the negative x side of pressure plate 6. Backup-side higher pressure region Db (bounded by the outer circumferential (peripheral border) line 213 of first seal member 210 and the inner circumferential (peripheral border) line 221 of second seal member 220) is shown by heavy broken lines, and the rotor-side discharge region Dp is shown by heavy solid lines.

Backup-side higher pressure region Db includes the first outer projecting subregion Dbout1 projecting radially outwards beyond the positive z side subregion Dpz+ of rotor-side discharge region Dp on the positive z side, and receiving the higher pressure as a part of backup higher pressure region Db. On the negative z side, first seal member 210 projects outwards beyond the negative z side outer circumference line 303 of rotor-side discharge region Dp, and therefore the backup-side higher pressure region Db further includes second and third outer projecting subregions Dbout2 and Dbout3 projecting radially outwards beyond the negative z side outer circumference line 303 of rotor-side discharge region Dp, and receiving the higher pressure as part of the backup higher pressure region Db.

Thus, backup-side higher pressure region Db on the negative x side broadens radially outwards beyond rotor-side discharge region Dp on the positive x side at the first, second and third outer projecting subregions Dbout1, Dbout2 and Dbout3 distributed around center hole 66. Therefore, the higher pressure pushes the backup surface 68 of pressure plate 6 in the positive x direction at the three points of the first outer projecting subregion Dbout1 on the positive z side, the second outer projecting subregion Dbout2 on the negative y side of the negative z side half, and the third outer projecting subregion Dbout3 on the positive y side of the negative z side half.

With this layout of backup higher pressure region Db, this seal structure can push pressure plate 6 with the high pressure in the positive x direction toward rotor 3 at the three points distributed around the rotor-side discharge region Dp in a balanced manner to hold the pressure plate 6 from being inclined with respect to drive shaft 2 (x axis). Therefore, this vane pump can improve the pump efficiency and prevent scratching.

The area Sb of backup-side higher pressure region Db is slightly greater than the area Sp of rotor-side discharge region Dp, and the ratio Sb/Sp therebetween is slightly greater than one. In this example, the ratio Sb/Sp is set equal to a value in the range of 1.06~1.12. In this example, the area Sb of backup-side higher pressure region Db is greater than the area Sp of rotor-side discharge region Dp by the amount equaling the sum of the areas of first, second and third outer projecting subregions Dbout1, Dbout2 and Dbout3.

Therefore, this seal structure can apply a slightly greater pressure to the pressure plate 6 from the backup side toward rotor 3, and thereby prevent deformation of pressure plate 6. Furthermore, axial clearances of cam ring 4, rotor 3 and vane 32 are controlled adequately with reference to the axial thickness of adapter ring 5, so as to attain improvement of the pump efficiency and prevention of scratching.

Effects of First Embodiment

[1] A variable displacement vane pump according to the illustrated example of the first embodiment comprises: a pump body (10); a drive shaft (2) supported by the pump body; a rotor (3) provided in the pump body and connected with the drive shaft to be driven by the drive shaft; a plurality of slots (31) formed (radially) in the rotor; a plurality of vanes (32) slidably received in the slots; a plurality of back pressure chambers (33) provided on a radial inner side of the slots; an annular cam ring (4) which is arranged to swing on a swing support point (Na) in the pump body, and to define a plurality of pumping chambers (B) with the vanes between the cam ring and the rotor enclosed in the cam ring; a rear body (12) and a pressure plate (6) provided on both sides of the cam ring in an axial direction, the pressure plate including a sliding surface (61) to contact with the rotor and a backup surface (68) opposite to the sliding surface; an inlet port (62) formed at least in the sliding surface (61) of the pressure plate in a volume increasing region in which volumes of the pumping chambers are increased, and an outlet port (63) formed in the sliding surface (61) in a volume decreasing region in which the volumes of the pumping chambers are decreased; an interspace surrounding the cam ring, and including a first pressure chamber (A1) on a side on which a discharge quantity increases and a second pressure chamber (A2) on a side on which the discharge quantity decreases; a pressure control valve (7) to control a fluid pressure to be introduced to the first or second pressure chamber; and an inlet-side back pressure groove (61*a*) formed in the sliding surface (61) on a radial inner side of the inlet port (62) and arranged to lead to the back pressure chambers (33), and an outlet-side back pressure groove (61*b*) formed in the sliding surface (61) on the radial inner side of the outlet port (63) and arranged to lead to the back pressure chambers (33).

In this vane pump, a rotor-side suction region (Ep) and a rotor-side discharge region (Dp) are defined in the sliding surface of the pressure plate. The rotor-side suction region (Ep) is a region which bounds a suction pump chamber which is one of the pumping chambers in fluid communication with the inlet port (and hence which is exposed to the pressure in the suction pump chamber). The rotor-side discharge region (Dp) is a region which bounds a discharge pump chamber which is one of the pumping chambers in fluid communication with the outlet port (and hence which is exposed to the pressure in the discharge pump chamber). In the backup surface (68) of the pressure plate on the side opposite to the rotor, there are defined a backup-side lower pressure region (Eb) formed at a position opposing the rotor-side suction region (Ep) and arranged to receive an intake pressure, and a backup-side higher pressure region (Db) formed at a position opposing the rotor-side discharge region (Dp) and arranged to receive a discharge pressure. The vane pump further comprises a seal member (210) provided on the backup surface (68) and arranged to separate the backup-side higher pressure region (Db) and the backup-side lower pressure region (Eb) from each other. In the sliding surface (61), there are defined a first closing region (Cp1) circumferentially between a leading end (603, 631*a*) of the outlet port (63) and a trailing end (601) of the inlet port (62), and a second closing region (Cp2) circumferentially between a leading end (602, 621*a*) of the inlet port (62) and a trailing end (604) of the outlet port (63). In the backup surface (68), there are defined a first projected higher pressure region (Cb1H) which is provided in a first projection region (Cb1) formed by projection of the first closing region (Cp1) on the backup surface and which is arranged to receive a higher pressure, and a second projected higher pressure region (Cb2H) which is provided in a second projection region (Cb2) formed by projection of the second closing region (Cp2) on the backup surface and which is arranged to receive the higher pressure.

In the thus-constructed vane pump, the portion receiving the application of the outlet (discharge) pressure and the portion receiving no application of the outlet pressure are balanced in pressure plate 6 so as to control the deformation of pressure plate 6. Therefore, this vane pump can reduce the friction loss during the rotation of the pump, and protect pressure plate 6 from scratching. Moreover, with pressure plate 6 protected against non-uniform deformation, this vane pump makes it possible to decrease the thickness of pressure plate 6, and to employ, for pressure plate 6, a slightly softer material having properties withstanding conditions tending to cause scratching.

[2] The discharge pressure is introduced into the inlet side back pressure groove, and the backup-side higher pressure region (Db) is so arranged that a projection of the backup-side higher pressure region on the sliding surface covers the inlet-side backpressure groove (61*a*) and extends on the radial outer side of the inlet-side backpressure groove.

The pressure applied on the backup-side higher pressure region (Db)(including a first outer projecting region Dbout1)

counteracts the discharge pressure introduced into the inlet-side back pressure groove (61*a*), and thereby improves the pressure balance.

[3] The leading end (603) of the outlet port (63) includes an outlet notch groove (631) extending (circumferentially) toward the trailing end (601) of the inlet port (62); the leading end (602) of the inlet port (62) includes an inlet notch groove (621) extending (circumferentially) toward the trailing end (601) of the inlet port (62); the first closing region (Cp1) is bounded (circumferentially) between the trailing end (601) of the inlet port (62) and the leading end of the outlet port defined by a leading end (631*a*) of the outlet notch groove (631); and the second closing region (Cp2) is bounded (circumferentially) between the trailing end (604) of the outlet port (63) and the leading end of the inlet port defined by a leading end (621*a*) the inlet notch groove (621).

The first and second closing regions Cp1 and Cp2 are regions in which the pressure condition in each pumping chamber is changed between suction and discharge with rotation of rotor 3 and vanes 32. Therefore, by setting the backup-side higher pressure region Db inclusive of first outer projecting region Dbout1 on the basis of the clearly defined first and second closing regions Cp1 and Cp2, it is possible to further improve the pressure balance in pressure plate 6.

[4] The area (Sb1H) of first projected higher pressure region (Cb1H) is greater than or equal to a half of the area (Sb1) of the whole first projection region (Cb1), and the area (Sb2H) of the second projected higher pressure region (Cb2H) is greater than or equal to a half of the area (Sb2) of the whole second projection region (Cb2).

In the closure region C of pressure plate 6, the pressure in each pumping chamber B is changed with rotation of rotor 3 and vane 32. Therefore, by setting the areas of the first and second projected higher pressure regions in this way, it is possible to balance the forces acting on pressure plate 6 and to restrain deformation of pressure plate 6. Moreover, by applying a force pushing pressure plate 6 from the negative x side (from backup surface 68) toward rotor 3, it is possible to reduce the clearance between pressure plate 6 and rotor 3, thereby to decrease leakage and to improve the pump efficiency.

[5] The variable displacement vane pump of the first embodiment further comprises a pin member (81) inserted through a pin hole (65) formed in the pressure plate and arranged to prevent rotation of the cam ring relative to the pump body. In the illustrated example, the pin hole (65) is formed at a position circumferentially between the swing support point (Na) and the trailing end (604) of outlet port (63), and the seal member is located radially between the outlet port and the pin hole. The seal member is so shaped that the pin hole is excluded from the backup-side higher pressure region (Db).

The pin hole (65) is formed in the backup-side lower pressure region (Eb). Therefore, the vane pump can prevent leakage of the outlet pressure through the pin hole (65) and thereby improve the pump efficiency.

[6] The inlet-side backpressure groove (61*a*) is so arranged that the discharge pressure is introduced into the inlet-side back pressure groove (61*a*), and the backup-side higher pressure region (Db) is so arranged that the backup side higher pressure region covers a projection of the inlet-side backpressure groove on the backup surface (68) and extends on the radial outer side of this projection of the inlet-side back pressure groove.

The pressure applied on the backup-side higher pressure region (Db)(including first outer projecting region Dbout1) counteracts the discharge pressure introduced into the inlet-side back pressure groove (61*a*), and thereby improves the pressure balance.

[7] The seal member (210) is so shaped that a radius (or radial distance) of the seal member (210) is smaller on a straight line connecting the drive shaft (2) and the pin hole (65) than on a straight line which does not pass through the pin hole (65). In the illustrated example, the seal member (210) has an outer circumference including a recessed segment recessed radially inwards at a position on the radial inner side of the pin hole (65) and a bulged segment bulging radially outwards from the recessed segment.

The thus-arranged seal member (210) which does not interfere with the pin hole (65) can improve the pump efficiency by preventing leakage through the pin hole, of the higher pressure sealed by the seal member, and improve the pressure balance without decreasing the area of the backup side higher pressure region too much.

[8] In addition to the seal member which is a first seal member (210) separating the backup-side higher pressure region (Db) and the backup-side lower pressure region (Eb), the vane pump further comprises a second seal member (220) provided on the backup surface (68) of the pressure plate, around the drive shaft (2) to separate backup-side higher pressure region (Db) from the drive shaft, and surrounded by the first seal member. The backup side higher pressure region Db covers the inlet-side and outlet-side backpressure grooves (61*a* and 61*b*). The outer periphery or circumference of the second seal member (220) is located on the radial outer side of the inner circumference or periphery of the inlet-side back-pressure groove (61*a*), and the inner periphery or circumference of the second seal member (220) is located on the radial inner side of the inner periphery of the inlet-side backpressure groove (61*a*).

The pressure plate (6) has the drive shaft center hole (66) opened through the pressure plate in a central region, so that the deformation tends to be increased in the central region of the pressure plate. Moreover, the inlet pressure is applied to the center region around the drive shaft center hole (66) on the radial inner side of inlet-side and outlet-side backpressure grooves (61*a* and 61*b*). Therefore, it is desirable to shift the inner circumference of the second seal member 220 radially outwards within the range to prevent leakage of the outlet pressure from the backpressure groove (61*a*, 61*b*) to the center hole (66). Accordingly, the second seal member (220) is so shaped and sized as to increase the area of an annular inner subregion of the lower pressure region Eb formed around the center hole (66) within the second seal member (220), and to decrease the area of the higher pressure region Db. The thus-constructed second seal member (220) can restrain the pressure applied to central region around the center hole (66) and prevent deformation around the center hole (66).

[9] The rotor (3) and pressure plate (6) are made of different materials. Therefore, it is possible to form a structure using a softer one of the rotor and pressure plate as a cushioning member to prevent seizure and scratching. Specifically when the material of the pressure plate is softer than the material of the rotor, the cushioning function is performed effectively by the pressure plate in which the pressure balance is improved.

[10] The backup-side higher pressure region (Db) is made greater than the rotor-side discharge region (Dp) so that a size ratio Sb/Sp of the area Sb of the backup-side higher pressure region to the area Sp of the rotor-side discharge region is in the range of 1.06~1.12. Therefore, it is possible to restrain deformation of the pressure plate with a slightly greater force applied from the backup side to the pressure plate. Furthermore, it is possible to set the axial clearances of cam ring (4), rotor (3) and vane (32) adequately with reference to the axial thickness of adapter ring (5), and to attain the improvement of the pump efficiency and prevention of scratching. In the example shown in FIG. 1, the adapter ring 5 as well as the rotor 3 and cam ring 4 is disposed axially between the pressure plate 6 and the rear body 12.

[11] The backup-side higher pressure region (Db) comprises a plurality of outer projecting regions projecting radially outwards, at a plurality of points distributed in a balanced manner around the drive shaft, beyond the rotor-side discharge region (Dp).22. In the example shown in FIG. 12, the backup-side higher pressure region (Db) includes first, second and third projecting regions. The first projecting region (Dbout1) is located radially between the inlet-side backpressure groove (61*a*) and the inlet port (62), the second and third projecting regions (Dbout2, Dbout3) are located radially between the outlet port (63) and the outer circumference of the pressure plate (6). The second and third projecting regions project radially outwards beyond a circle passing through the pin hole (65) and encircling the center axis of the drive shaft as the center. Moreover, the pin hole (65) is located circumferentially between the second and third projecting regions (Dbout2, Dbout3). These outer projecting regions on the backup side are arranged to push the pressure plate and thereby support the pressure plate at a plurality of positions distributed around the drive shaft. Therefore, this structure can prevent inclination of the pressure plate (6) and at the same time improve the pump efficiency and the resistance to scratching.

Second Embodiment

Figure 13:
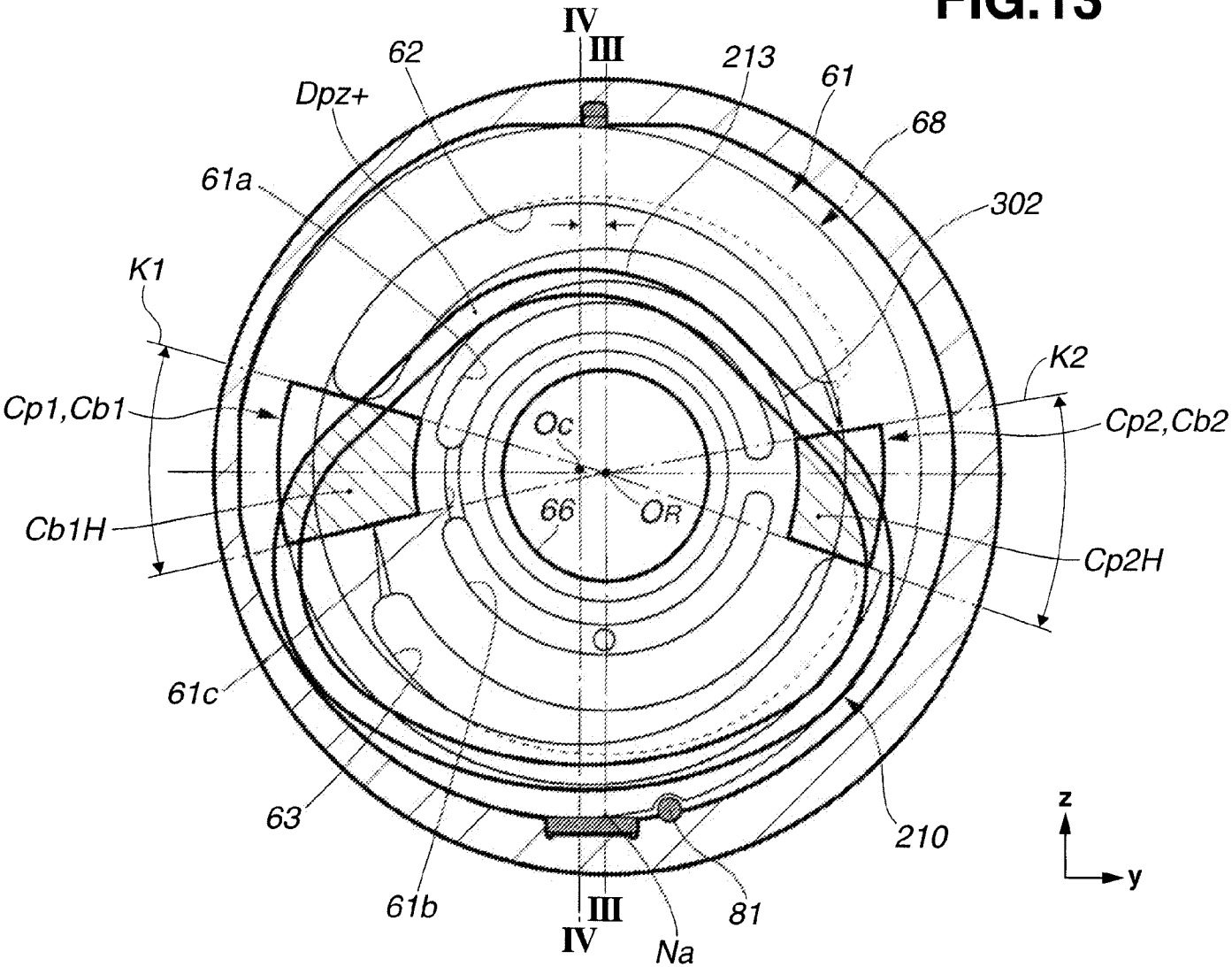
FIG. 13 is a front elevational view of a pressure plate 6 in a variable displacement vane pump according to a second embodiment, to show the positive x side.
Figure 14:
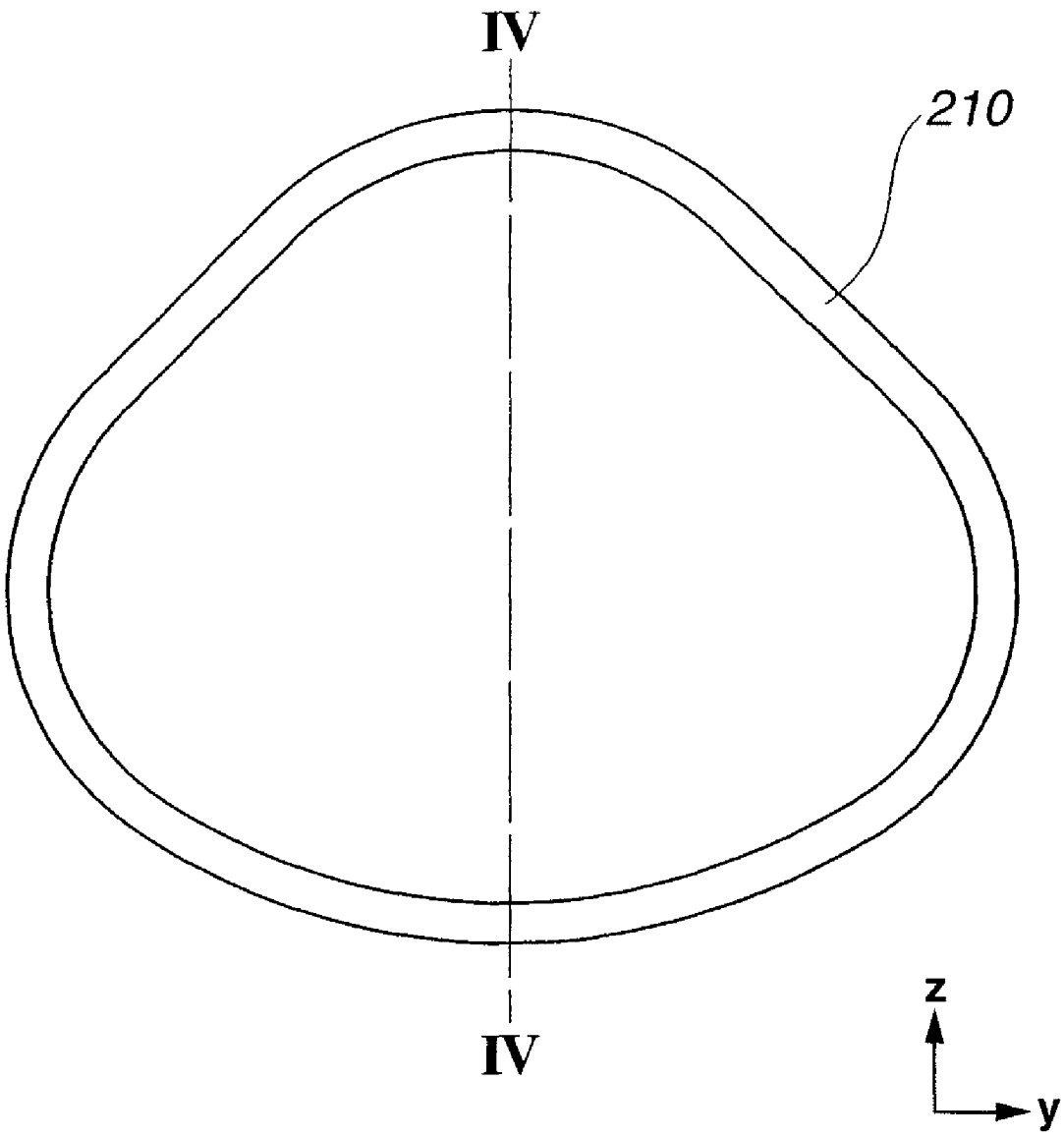
FIG. 14 is a view showing the first seal member 210 of the vane pump according to the second embodiment.

FIGS. 13 and 14 are views for showing a variable displacement vane pump according to a second embodiment of the present invention. The basic structure of the vane pump 1 of the second embodiment is identical to that of the first embodiment. In the second embodiment, however, the first seal member 210 is offset from a median plane III-III containing the center axis (OR). FIG. 13 shows the sliding surface 61 of pressure plate 6 according to the second embodiment on the positive x side, and FIG. 14 shows the first seal member 210. In FIG. 13, first seal member 210 is shown by a solid line for clarification though it is disposed on the negative x side (backup surface 68) of pressure plate 6, and the second seal member 220 is omitted because second seal member 220 is arranged symmetrically with respect to the median plane III-III as in the first embodiment.

As shown in FIG. 13, first seal member 210 is arranged symmetrically with respect to an offset plane IV-IV which is parallel to the median plane III-III and which is offset to the negative y side. Therefore, first seal member 210 is not symmetrical with respect to the median plane III-III passing through the circumferential middle points of inlet and outlet ports 62 and 63. The offset plane IV-IV is an imaginary flat plane parallel to the median flat plane III-III, and passing through the center Oc of cam ring 4 in the state shown in FIG. 13.

Because of the eccentricity of cam ring 4, the area of first closing region Cp1 in sliding surface 61 becomes greater than the area of second closing region Cp2. Accordingly, first seal member 210 is arranged to make the first projection higher pressure subregion Cb1H broader than the second projection higher pressure subregion Cb2H in backup surface 68 adequately to push the first and second closing regions Cp1 and Cp2 in a balanced manner. This asymmetric arrangement in which the area of first projection higher pressure subregion Cb1H is greater than the area of second projection higher pressure subregion Cb2H is effective to improve the pressure balance in pressure plate 6 and improve the pump efficiency and the resistance to scratching.

The outer circumference 213 of first seal member 210 shown in FIG. 13 is located on the radial outer side of the positive z side outer circumference 302 of rotor-side discharge region Dp, and there is formed the first outer projecting region Dbout1 projecting on the radial outer side of the rotor-side discharge region Dp.

As in the first seal member of the first embodiment, first seal member 210 of FIG. 13 projects radially outwards beyond the negative z side outer circumference 303 of rotor-side discharge region Dp at two points to form the second and third outer projecting regions Dbout2 and Dbout3. Therefore, pressure plate 6 is pushed and supported at the three points defined by the first, second and three outer projecting regions Dbout1, Dbout2 and Dbout3. The first seal member 210 of the second embodiment is bilateral-symmetrical with respect to the plane IV-IV, and the two opposite sides of the seal member 210 are identical in shape so that the assemblage is easier.

Effects of the Second Embodiment

The area of the first projection higher pressure subregion Cb1H is greater than the area of second projection higher pressure subregion Cb2H. This arrangement is effective to improve the pressure balance in pressure plate 6 and improve the pump efficiency and the resistance to scratching. The first seal member 210 of the second embodiment is bilateral-symmetrical. The first seal member 210 having the same two opposite sides makes it easier to set the seal member in the vane pump.

Third Embodiment

Figure 15:
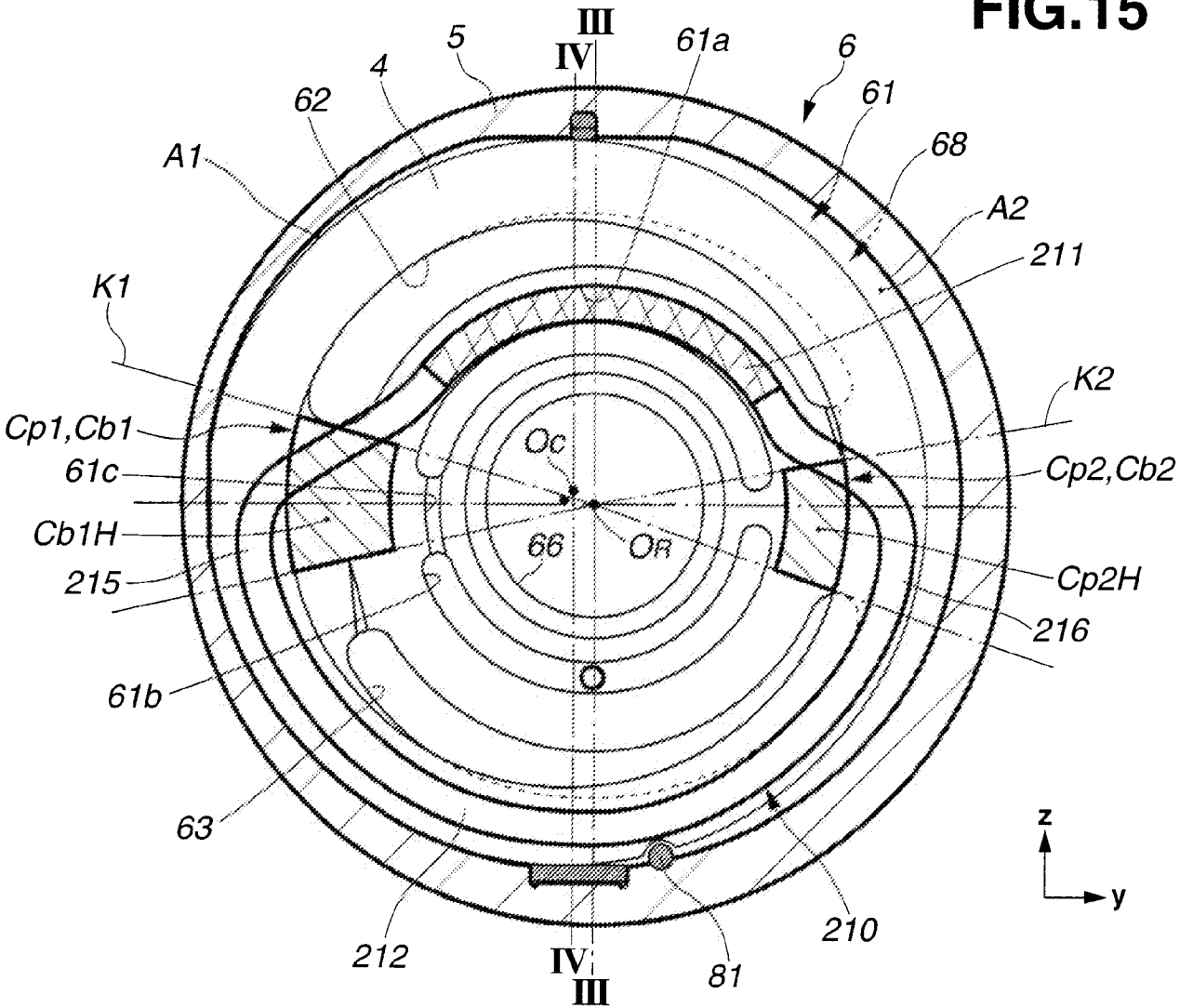
FIG. 15 is a front elevational view of a pressure plate 6 in a variable displacement vane pump according to a third embodiment, to show the positive x side.

FIG. 15 is a view for showing a variable displacement vane pump according to a third embodiment of the present invention. The basic structure of the vane pump 1 of the third embodiment is identical to that of the second embodiment. In the third embodiment, however, the first seal member 210 is asymmetric. FIG. 15 shows the sliding surface 61 of pressure plate 6 on the positive x side. In FIG. 15, first seal member 210 is shown by a solid line for clarification, and second seal member 220 is omitted.

First seal member 210 of FIG. 15 includes first and second intermediate segments 215 and 216 extendings radially outwards in first and second closing regions Cp1 and Cp2, and the first intermediate segment 215 on the negative y side projects radially outwards to a greater extent than the second intermediate segment 216 on the positive y side.

Therefore, first seal member 210 of FIG. 15 is not exactly bilateral-symmetrical with respect to plane IV-IV. First seal member 210 makes the area of first projection higher pressure subregion Cb1H greater than the area of second projection higher pressure subregion Cb2H as in the second embodiment so as to improve the pressure balance in pressure plate 6.

In the greatest swing state (in which cam ring 4 is swung most to the negative y side), the discharge quantity is increased, so that the force the pressure plate 6 receives from the pumping chambers on the positive x side becomes greater. Therefore, the area of first projection higher pressure subregion Cb1H on the negative y side (the greatest swing side) is increased by projecting the intermediate segment 215 as compared to the area of second projection higher pressure subregion Cb2H on the positive y side. Therefore, the force applied from the backup side to pressure plate 6 is increased, and the pressure balance is improved in accordance with the swing state of cam ring 4.

The outlet-side segment of first seal member 210 is shaped in conformity with the outer circumference of cam ring 4 in the greatest eccentricity state. Thus, the first seal member 210 is positioned and shaped to define first projection higher pressure subregion Cb1H effectively in accordance with the position of cam ring 4 in the state in which the discharge pressure is increased, so that the pressure balance is further improved in accordance with the swing state of cam ring 4.

The inlet-side segment 211 (cross-hatched portion) of first seal member 210 on the positive z side of lines K1 and K2 is bilateral-symmetrical though first seal member 210 as a whole is not symmetrical with respect to the straight line IV-IV and straight line III-III. Since the inlet-side backpressure groove 61*a* is bilateral-symmetrical with respect to the median line III-III. Therefore, the inlet-side segment 211 is formed symmetrically on the radial outer side of inlet-side backpressure groove 61*a* so as to form a symmetrical seal structure of inlet-side segment 211 and inlet-side backpressure groove 61*a* with respect to the median line III-III, to further improve the pressure balance.

The seal member 210 is offset to the side on which the eccentricity of cam ring 4 is increased. In the greatest swing state, the discharge quantity is increased, so that the force the pressure plate 6 receives from the sliding surface 61*e* becomes greater. Therefore, the area of first projection higher pressure subregion Cb1H on the negative y side is increased by projecting the intermediate segment 215 as compared to the area of second projection higher pressure subregion Cb2H on the positive y side. Therefore, the force applied from the backup side to pressure plate 6 is increased in the greatest swing state, and the pressure balance is improved in accordance with the swing state of cam ring 4.

On the negative z side around the outlet port 63, the first seal member 210 is shaped in conformity with the outer circumference of cam ring 4 in the greatest eccentricity state. Therefore, seal member 210 and the first projection higher pressure region Cb1H are formed adequately in accordance with cam ring 4 in the greatest eccentricity state to improve the pressure balance.

As explained above, according to the illustrated embodiments, a variable displacement vane pump comprises: a rotor (3); an annular cam ring (4); a pump body (10) which may include a circumferential wall surround the rotor and the cam ring, and first and second end walls (111, 12) on both sides of the rotor; and a pressure plate (6) which is disposed between the first end wall of the pump body and the rotor and which includes a backup surface and a sliding surface formed with inlet and outlet ports and a backpressure groove. The vane pump further comprises a seal member (210) which is provided axially between (the backup surface 68 of) the pressure plate and the first end wall of the pump body, and which includes an inlet-side segment extending on the radial inner side of the inlet port, around the backpressure groove, and an outlet-side segment extending on the radial outer side of the outlet port. The backpressure groove may include an inlet-side backpressure groove (61*a*) and an outlet-side backpressure groove (61*b*). In addition to the pressure plate (6) between the first end wall and the rotor, the vane pump may further include a second pressure plate disposed between the second end wall and the rotor, and constructed in the same manner as the first pressure plate between the first end wall and the rotor, with a seal member between the second pressure plate and the second end wall.

The seal member is a first seal member (210), and the vane pump may further comprise a drive shaft (2) arranged to drive the rotor and inserted through a center hole (66) formed in the pressure plate, and a second seal member (220) which is provided between the backup surface of the pressure plate and the end wall (111) of the pump body, and which encloses the center hole. The first seal member has a closed shape like a closed plane figure, and surrounds the second seal member so as to define a confined interspace radially between the first and second seal members, and axially between the pressure plate and the end wall of the pump body.

In the illustrated examples of the first, second and third embodiments, the inlet port extends circumferentially around the center hole like a circular arc from a first end to a second end within a first annular zone around the center hole in an inlet-side sector, and the outlet port extends circumferentially around the center hole like a circular arc from a first end to a second end within the first annular zone around the center hole in an outlet-side sector. The inlet port and outlet port confront each other diametrically across the center hole (66). The inlet-side segment of the first seal member of the illustrated example extends circumferentially like a circular arc along the inlet port on the radial inner side of the inlet port, the outlet-side segment of the first seal member extends circumferentially like a circular arc along the outlet port on the radial outer side of the outlet port, and the inlet-side segment and outlet-side segment of the first seal member confront each other diametrically across the center hole. The first seal member further includes a first intermediate segment extending from the radial inner side of the first annular zone to the radial outer side of the first annular zone in a first intermediate sector between the inlet-side sector and the outlet-side sector and connecting a second end of the inlet-side segment with a first end of the outlet-side segment, and a second intermediate segment extending from the radial outer side of the first annular zone to the radial inner side of the first annular zone in a second intermediate sector between the outlet-side sector and the inlet-side sector and connecting a second end of the outlet-side segment with a first end of the inlet-side segment. The first annular zone can be considered to be an annular portion bounded between outer and inner imaginary cylindrical surfaces each generated by moving an imaginary straight line around the center axis of the central hole so that the imaginary straight line remains parallel to the center axis. The imaginary outer and inner cylindrical surfaces may be in the form of curved surfaces of right circular cylinders and may be arranged coaxially around the center axis as the common axis. (Each of later-mentioned annular zones can be defined in the same manner.) Each of the inlet-side sector, outlet-side sector and first and second intermediate sectors is a sectorial portion bounded by two imaginary radial flat planes (such as planes shown by lines K1 and K2 in FIG. 4) containing the center axis and shown in the form of a sector of a circle in a figure of the pressure plate as viewed axially as in FIG. 4.

In the illustrated examples of the first, second and third embodiments, the backpressure groove (61*a*, 61*b*, 61*c*) is formed in a second annular zone surrounded by the first annular zone. There are further formed an outer annular zone which surrounds the first annular zone, an intermediate annular zone which is located radially between the first and second annular zones, and an inner annular zone which is formed around the center hole within the second annular zone. The inlet-side segment of the first seal member (210) extends circumferentially in the intermediate annular zone at least in the vicinity of the middle of the inlet port, whereas the outlet-side segment of the first seal member extends in the outer annular zone outside the outlet port. Each of the first and second seal members may be received in a seal groove formed in at least one of the pressure plate and the end wall of the pump body.

According to the second and third embodiments, the first seal member (210) is asymmetrical with respect to an imaginary median plane (III-III) containing a rotation axis (OR) of the rotor (3) and a swing axis (Na) of the cam ring (4) so that the backup-side higher pressure region (Db) enclosed by the first seal member is divided by the imaginary median plane into a larger first half (left half as viewed in FIG. 13 and FIG. 15) on a first (left) side of the imaginary median plane on which the first intermediate segment is located, and a smaller second half (right half as viewed in FIG. 13 and FIG. 15) smaller than the larger first half on a second (right) side of the imaginary median plane on which the second intermediate segment is located. The cam ring (4) is arranged to swing on the swing axis (Na) and normally urged (by spring 71) toward the first (left) side.

This application is based on a first prior Japanese Patent Application No. 2007-212857 filed on Aug. 17, 2007. The entire contents of this Japanese Patent Application are hereby incorporated by reference.

Although the invention has been described above by reference to certain embodiments of the invention, the invention is not limited to the embodiments described above. Modifications and variations of the embodiments described above will occur to those skilled in the art in light of the above teachings. The scope of the invention is defined with reference to the following claims.

What is claimed is:

1. A variable displacement vane pump comprising:

a rotor formed with a plurality of slots each having a backpressure chamber, and provided with a plurality of vanes each slidably received in one of the slots and arranged to be urged radially outwards by a pressure in the backpressure chamber;

an annular cam ring receiving therein the rotor rotatably, the cam ring being arranged to swing, and to define a plurality of pumping chambers with the vanes between the rotor and the cam ring;

a pump body encasing the cam ring and the rotor and including an end wall;

a pressure plate disposed between the end wall of the pump body and the rotor, the pressure plate including:

a sliding surface facing toward the rotor and the cam ring, a backup surface opposite to the sliding surface, an inlet port formed in the sliding surface, to supply an operating fluid into the pumping chambers, an outlet port formed in the sliding surface, to discharge the operating fluid from the pumping chambers, and a backpressure groove formed in the sliding surface to communicate with the backpressure chambers; and a first seal member which is provided between the backup surface and the end wall, the first seal member including:

an inlet-side segment extending on a radial inner side of the inlet port and a radial outer side of the backpressure groove, and an outlet-side segment extending on the radial outer side of the outlet port;

wherein the outlet-side segment of the first seal member includes an outer circumference including first and second convex portions, and a concave portion which is located circumferentially between the first and second convex portions, and which is recessed so that a radial distance from a center axis of the pressure plate is smaller at the concave portion than at the first and second convex portions.

2. The variable displacement pump as claimed in claim 1, wherein the pressure plate is formed with a pin hole receiving a pin member arranged to prevent rotation of the cam ring, and the concave portion of the outer circumference of the outlet-side segment of the first seal member is located radially between the outlet port and the pin hole.

3. The variable displacement vane pump as claimed in claim 2, further comprising:

a drive shaft supported by the pump body, wherein:

the rotor is provided in the pump body, connects with the drive shaft to be driven by the drive shaft, and is formed with the plurality of the slots, each of the plurality of the vanes is slidably received in one of the slots, each of the plurality of the backpressure chambers is provided on a radial inner side of one of the slots, the annular cam ring surrounds the rotor, the cam ring is arranged to swing about a swing support point in the pump body and to define the plurality of pumping chambers with the vanes between the rotor and the cam ring;

first and second plate members provided on both sides of the cam ring in an axial direction, the second plate member being the pressure plate including the sliding surface to contact with the rotor and the backup surface facing away from the rotor;

wherein the inlet port is formed in the sliding surface of the second plate member in a volume increasing region in which volumes of the pumping chambers are increased, and the outlet port formed in the sliding surface of the second plate member in a volume decreasing region in which the volumes of the pumping chambers are decreased;

an interspace surrounding the cam ring, and including a first fluid pressure chamber on a side on which a discharge quantity increases and a second fluid pressure chamber on a side on which the discharge quantity decreases;

a pressure control device to control a fluid pressure to be introduced to the first or second pressure chamber;

wherein the backpressure groove includes an inlet-side backpressure groove formed in the sliding surface on the radial inner side of the inlet port and arranged to lead to the backpressure chambers, and an outlet-side back pressure groove formed in the sliding surface on the radial inner side of the outlet port and arranged to lead to the back pressure chambers;

a rotor-side suction region defined in the sliding surface of the second plate member, the rotor-side suction region being a region bounding a suction pump chamber which is one of the pumping chambers in fluid communication with the inlet port;

a rotor-side discharge region defined in the sliding surface of the second plate member, the rotor-side discharge region being a region bounding a discharge pump chamber which is one of the pumping chambers in fluid communication with the outlet port;

a backup-side lower pressure region formed in the backup surface of the second plate member at a position opposing the rotor-side suction region and arranged to receive an intake pressure;

a backup-side higher pressure region formed in the backup surface of the second plate member at a position opposing the rotor-side discharge region and arranged to receive a discharge pressure;

wherein the first seal member is provided on the backup surface and arranged to separate the backup side higher pressure region and the backup-side lower pressure region from each other;

a first closing region defined in the sliding surface and bounded between a leading end of the outlet port and a trailing end of the inlet port;

a second closing region defined in the sliding surface and bounded between a leading end of the inlet port and a trailing end of the outlet port;

a first projected higher pressure region which is provided in a first projection region formed by projection of the first closing region on the backup surface and which is arranged to receive a higher pressure; and a second projected higher pressure region which is provided in a second projection region formed by projection of the second closing region on the backup surface and which is arranged to receive the higher pressure.

4. The variable displacement vane pump as claimed in claim 3, wherein the inlet-side back pressure groove is so arranged that the discharge pressure is introduced into the inlet-side backpressure groove, and the backup-side higher pressure region is so arranged that a projection of the backup side higher pressure region on the sliding surface covers the inlet-side backpressure groove and extends on the radial outer side of the inlet-side backpressure groove.

5. The variable displacement vane pump as claimed in claim 3, wherein:

the leading end of the outlet port includes an outlet notch groove extending toward the trailing end of the inlet port;

the leading end of the inlet port includes an inlet notch groove extending toward the trailing end of the inlet outlet port;

the first closing region is bounded between the trailing end of the inlet port and the leading end of the outlet port defined by a leading end of the outlet notch groove; and the second closing region is bounded between the trailing end of the outlet port and the leading end of the inlet port defined by a leading end the inlet notch groove.

6. The variable displacement vane pump as claimed in claim 3, wherein:

the first projected high pressure region has an area greater than or equal to a half of an area of the first projection region formed by projection of the first closing region on the backup surface, and the second projected high pressure region has an area greater than or equal to a half of an area of the second projection region formed by projection of the second closing region on the backup surface.

7. The variable displacement vane pump as claimed in claim 3, further comprising the pin member inserted through the pin hole formed in the second plate member and arranged to prevent rotation of the cam ring relative to the pump body, and the first seal member is located radially between the outlet port and the pin hole.

8. The variable displacement vane pump as claimed in claim 7, wherein the first seal member has an outer circumference including a recessed segment recessed radially inwards at a position on the radially inner side of the pin hole and a bulged segment bulging radially outwards from the recessed segment.

9. The variable displacement vane pump as claimed in claim 3, wherein an area of the first projected higher pressure region is greater than an area of the second projected higher pressure region.

10. The variable displacement vane pump as claimed in claim 9, wherein the first seal member is substantially symmetrical with respect to a median plane which is offset from an axis of the drive shaft.

11. The variable displacement vane pump as claimed in claim 9, wherein the first seal member is asymmetric with respect to a center plane extending axially and bisecting each of the inlet port and the outlet port.

12. The variable displacement vane pump as claimed in claim 9, wherein the first seal member further includes an asymmetric segment which is asymmetric with respect to a center plane extending axially and bisecting each of the inlet port and the outlet port, and a symmetric segment which extends in a region radially between the inlet-side backpressure groove and the inlet port, and which is symmetrical with respect to the center plane extending axially and bisecting each of the inlet port and the outlet port.

13. The variable displacement pump as claimed in claim 9, wherein the first seal member is offset to a side to which an eccentricity of the cam ring is increased.

14. The variable displacement vane pump as claimed in claim 13, wherein the first seal member further includes an outlet-side segment shaped in conformity with an outer circumference of the cam ring at a position at which the eccentricity of the cam ring is greatest.

15. The variable displacement vane pump as claimed in claim 3, wherein, in addition to the first seal member separating the backup-side higher pressure region and the backup-side lower pressure region, the variable displacement vane pump further comprises a second seal member provided on the backup surface of the pressure plate, around the drive shaft and surrounded by the first seal member.

16. The variable displacement vane pump as claimed in claim 3, wherein the rotor is made of a first material, and the second plate member is made of a second material different from the first material.

17. The variable displacement vane pump as claimed in claim 16, wherein an area of the first closing region is greater than an area of the second closing region.

18. The variable displacement vane pump as claimed in claim 16, wherein the second material of the second plate member is softer than the first material of the rotor.

19. The variable displacement vane pump as claimed in claim 18, wherein the first material of the rotor is a ferrous material, and the second material of the second plate member is a non-ferrous alloy which is one of an aluminum alloy and a copper alloy.

20. The variable displacement vane pump as claimed in claim 18, wherein the second plate member comprises a surface layer of a non-ferrous alloy which is formed on a base material by vapor deposition.

21. The variable displacement vane pump as claimed in claim 3, wherein an area Sb of the backup-side higher pressure region is greater than an area Sp of the rotor-side discharge region.

22. The variable displacement vane pump as claimed in claim 21, wherein a size ratio Sb/Sp of the area Sb of the backup-side higher pressure region to the area Sp of the rotor-side discharge region is in a range of 1.06-1.12.

23. The variable displacement vane pump as claimed in claim 3, wherein the backup-side higher pressure region comprises a plurality of outer projecting regions projecting radially outwards, at a plurality of points distributed around the drive shaft, beyond the rotor-side discharge region.

24. The variable displacement vane pump as claimed in claim 23, wherein the outer projecting regions are first, second and third projecting regions, the first projecting region is located radially between the inlet-side backpressure groove and the inlet port, and the second and third projecting regions are located radially between the outlet port and an outer circumference of the second plate member.

25. The variable displacement vane pump as claimed in claim 1, wherein the variable displacement vane pump further comprises:

a drive shaft arranged to drive the rotor and inserted through a center hole formed in the pressure plate; and a second seal member which is provided between the backup surface and the end wall, and which surrounds the center hole, wherein the first seal member has a closed shape surrounding the center hole, and surrounds the second seal member to define a backup-side higher pressure region between the first and second seal members to push the pressure plate toward the rotor with a discharge pressure introduced into the backup-side higher pressure region.

26. The variable displacement pump as claimed in claim 25, wherein the second seal member includes an outer circumference located on the radial outer side of an inner circumference of the backpressure groove and an inner circumference located on the radial inner side of the inner circumference of the backpressure groove.

27. The variable displacement vane pump as claimed in claim 25, wherein the inlet port extends circumferentially around the center hole from a first end to a second end within a first annular zone around the center hole in an inlet-side sector, the outlet port extends circumferentially around the center hole from a first end to a second end within the first annular zone around the center hole in an outlet-side sector, and wherein the first seal member further includes:

a first intermediate segment extending from the radial inner side of the first annular zone to the radial outer side of the first annular zone, passing through a first intermediate sector between the inlet-side sector and the outlet-side sector and connecting a second end of the inlet-side segment with a first end of the outlet-side segment, and a second intermediate segment extending from the radial outer side of the first annular zone to the radial inner side of the first annular zone, passing through a second intermediate sector between the outlet-side sector and the inlet-side sector and connecting a second end of the outlet-side segment with a first end of the inlet-side segment.

28. The variable displacement pump as claimed in claim 1, wherein the rotor is made of a first material, and the pressure plate is made of a second material different from the first material.

29. A variable displacement vane pump comprising:

a rotor formed with a plurality of slots each having a backpressure chamber, and provided with a plurality of vanes each slidably received in one of the slots and arranged to be urged radially outwards by a pressure in the backpressure chamber;

an annular cam ring receiving therein the rotor rotatably, the cam ring being arranged to swing, and to define a plurality of pumping chambers with the vanes between the rotor and the cam ring;

a pump body encasing the cam ring and the rotor and including an end wall;

a pressure plate disposed between the end wall of the pump body and the rotor, the pressure plate including:

a sliding surface facing toward the rotor and the cam ring, a backup surface opposite to the sliding surface, an inlet port formed in the sliding surface, to supply an operating fluid into the pumping chambers, an outlet port formed in the sliding surface, to discharge the operating fluid from the pumping chambers, and a backpressure groove formed in the sliding surface to communicate with the backpressure chambers; and a first seal member which is provided between the backup surface and the end wall, the first seal member further including:

an inlet-side segment extending on a radial inner side of the inlet port and a radial outer side of the backpressure groove, and an outlet-side segment extending on the radial outer side of the outlet port;

a drive shaft arranged to drive the rotor and inserted through a center hole formed in the pressure plate; and a second seal member which is provided between the backup surface and the end wall, and which surrounds the center hole, wherein the first seal member has a closed shape surrounding the center hole, and surrounds the second seal member to define a backup-side higher pressure region between the first and second seal members to push the pressure plate toward the rotor with a discharge pressure introduced into the backup-side higher pressure region, wherein the inlet port extends circumferentially around the center hole from a first end to a second end within a first annular zone around the center hole in an inlet-side sector, the outlet port extends circumferentially around the center hole from a first end to a second end within the first annular zone around the center hole in an outlet-side sector, and wherein the first seal member includes:

a first intermediate segment extending from the radial inner side of the first annular zone to the radial outer side of the first annular zone, passing through a first intermediate sector between the inlet-side sector and the outlet-side sector and connecting a second end of the inlet-side segment with a first end of the outlet-side segment, and a second intermediate segment extending from the radial outer side of the first annular zone to the radial inner side of the first annular zone, passing through a second intermediate sector between the outlet-side sector and the inlet-side sector and connecting a second end of the outlet-side segment with a first end of the inlet-side segment, and wherein the first seal member is asymmetrical with respect to an imaginary median plane containing a rotation axis of the rotor and a swing axis of the cam ring so that the backup-side higher pressure region enclosed by the first seal member is divided by the imaginary median plane into a larger first half on a first side of the imaginary median plane on which the first intermediate segment is located, and a smaller second half smaller than the larger first half on a second side of the imaginary median plane on which the second intermediate segment is located.

* * * * *